US008777521B2

(12) United States Patent
Nagata et al.

(10) Patent No.: US 8,777,521 B2
(45) Date of Patent: Jul. 15, 2014

(54) STEEL PIPE PILE AND METHOD OF INSTALLING THE STEEL PIPE PILE

(75) Inventors: Makoto Nagata, Tokyo (JP); Masamichi Sawaishi, Tokyo (JP); Masatoshi Wada, Tokyo (JP)

(73) Assignee: Nippon Steel Engineering Co., Ltd., Tokyo (JP)

( * ) Notice: Subject to any disclaimer, the term of this patent is extended or adjusted under 35 U.S.C. 154(b) by 304 days.

(21) Appl. No.: 13/263,357

(22) PCT Filed: Mar. 16, 2010

(86) PCT No.: PCT/JP2010/054908

§ 371 (c)(1),
(2), (4) Date: Oct. 31, 2011

(87) PCT Pub. No.: WO2010/116884

PCT Pub. Date: Oct. 14, 2010

(65) Prior Publication Data

US 2012/0037261 A1 Feb. 16, 2012

(30) Foreign Application Priority Data

Apr. 10, 2009 (JP) ..... 2009-096207

(51) Int. Cl.

| | |
|---|---|
| ***E02D 5/28*** | (2006.01) |
| ***E02D 5/56*** | (2006.01) |
| ***E21B 17/22*** | (2006.01) |
| ***E21B 10/44*** | (2006.01) |
| ***E02D 5/80*** | (2006.01) |

(52) U.S. Cl.

CPC ..... *E02D 5/801* (2013.01)
USPC ..... 405/253; 405/249; 405/252.1; 175/323; 175/394

(58) Field of Classification Search

USPC ..... 405/229, 231, 232, 249, 251, 252.1, 405/253; 52/157, 153, 154; 175/323, 394
See application file for complete search history.

(56) References Cited

U.S. PATENT DOCUMENTS 4,790,689 A * 12/1988 Henn et al. ..... 405/240
5,137,394 A * 8/1992 Tateno et al. ..... 405/232

(Continued)

FOREIGN PATENT DOCUMENTS

JP 60-181434 U 12/1985
JP 6-24420 Y2 6/1994

(Continued)

OTHER PUBLICATIONS

International Search Report, dated Apr. 20, 2010 in PCT/JP2010/054908.

*Primary Examiner* — David Bagnell
*Assistant Examiner* — Kyle Armstrong
(74) *Attorney, Agent, or Firm* — Birch, Stewart, Kolasch & Birch, LLP

(57) ABSTRACT

A steel pipe pile having pile bearing capacity without disturbing the surrounding ground during installation. The steel pipe pile including a first steel pipe pile that has a hollow steel pipe and a first helical fin on the outer periphery thereof from one end toward the other end at a constantly equal pitch; and a second steel pipe pile that has a hollow steel pipe and a helical fin on the outer periphery thereof from one end toward the other end at a constantly equal pitch and that is joined at an end to the other end of the first steel pipe pile, the pitch of the first helical fin and the pitch of the second helical fin being equal, and the first helical fin and second helical fin being continuous along an imaginary helix at the joint between the first steel pipe pile and the second steel pipe pile.

16 Claims, 20 Drawing Sheets

(56) References Cited

U.S. PATENT DOCUMENTS

| | | | | |
|---|---|---|---|---|
| 5,875,860 | A * | 3/1999 | Coelus | 175/323 |
| 2002/0090271 | A1 | 7/2002 | Saeki et al. | |

FOREIGN PATENT DOCUMENTS

| | | | |
|---|---|---|---|
| JP | 8-35228 | A | 2/1996 |
| JP | 8-284160 | A | 10/1996 |
| JP | 10-183617 | A | 7/1998 |
| JP | 11-36287 | A | 2/1999 |
| JP | 11-179517 | A | 7/1999 |
| JP | 11-247189 | A | 9/1999 |
| JP | 11-269875 | A | 10/1999 |
| JP | 2001-3359 | A | 1/2001 |
| JP | 2001-146741 | A | 5/2001 |
| JP | 2002-105954 | A | 4/2002 |
| JP | 2003-293361 | A | 10/2003 |
| JP | 2004-11204 | A | 1/2004 |
| JP | 2004-316421 | A | 11/2004 |
| JP | 2005-68987 | A | 3/2005 |
| JP | 2006-104938 | A | 4/2006 |

* cited by examiner

STEEL PIPE PILE AND METHOD OF INSTALLING THE STEEL PIPE PILE

TECHNICAL FIELD

This invention relates to a steel pipe pile and a method of installing the steel pipe pile, and particularly relates to a steel pipe pile having a helical fin formed on the steel pipe periphery and a method of installing the steel pipe pile.

BACKGROUND ART

Steel pipe piles are installed in the ground to support the upper structures of civil engineering structures such as buildings, roads, railway viaducts, abutments, pylons and the like. At this time, the steel pipe piles are driven into the ground while being rotated using a rotary steel pipe pile driver such as, for example, a rotary all casing boring machine or a small crawler pile driver. Such steel pipe piles for rotational driving include, for instance, ones having a helical fin formed on the pile tip.

As a method for driving a steel pipe pile into the ground, Patent Document 1 teaches a method in which a helical fin is formed on the tip of the steel pipe pile and the steel pipe pile is sunk vertically into the ground from the ground surface under rotation. Further, Patent Documents 2 to 4 teach piles having helical plates (helical blades) formed on the pile periphery.

PRIOR ART REFERENCES

Patent Documents

Patent Document 1
JP-A-2001-146741
Patent Document 2
JP-A-8-35228
Patent Document 3
JP-A-8-284160
Patent Document 4
JP-A-10-183617

SUMMARY OF THE INVENTION

Problem to be Solved by the Invention

When a steel pipe pile having a helical blade formed on the steel pipe periphery is driven into the ground, unless the pitch of the helical blade is constant and the pile is installed to an amount of penetration conforming to the pitch, the position of the helical blade passing through the ground goes up and down, so that there are problems such as that the ground around the pile is disturbed during the installation and the bearing capacity of the pile declines. In other words, in order to enhance the pile bearing capacity, it is desirable for the earth charged between the helical blade to be firmly packed with the least possible disturbance of the ground around the pile.

In this connection, as in Patent Document 3, there are cases in which a steel pipe pile has multiple helical blades formed on the steel pipe periphery and the individual helical blades are attached as separated from one another by a prescribed distance. However, if after one of the helical blades passes through the ground around the steel pipe, another helical blade then passes through the ground around the steel pipe, the other helical blade may pass through different places even if installed in conformity with the pitch, so that the ground may be disturbed.

Further, not only with a steel pipe pile having multiple helical blades formed on the periphery of a single steel pipe, but even in the case of a steel pipe pile having a single continuous helical blade formed on the periphery of a single steel pipe, a problem like that mentioned above occurs when the steel pipe pile is connected to another steel pipe pile and the piles are driven into the ground. For example, after the helical blade of one of the steel pipe piles passes through the ground around the steel pipe, if the helical blade of the other steel pipe pile then passes through the ground around the steel pipe, the other helical blade may pass through different places even if installed in conformity with the pitch, so that the ground may be disturbed.

The present invention was therefore accomplished in the light of the foregoing problems and has as its object to provide a novel and improved steel pipe pile and steel pipe pile installation method that make it possible to ensure the bearing capacity of the pile without disturbing the surrounding ground during pile installation.

Means for Solving the Problems

In order to overcome the aforesaid problems, in accordance with an aspect of the present invention, there is provided a steel pipe pile characterized by comprising a first steel pipe pile that has a hollow first steel pipe and a first helical fin formed helically for at least one turn on the outer periphery of the first steel pipe from one end toward the other end of the first steel pipe at a constantly equal pitch; a second steel pipe pile that has a hollow second steel pipe and a second helical fin formed helically for at least one turn on the outer periphery of the second steel pipe from one end toward the other end of the second steel pipe at a constantly equal pitch and that is joined at an end to the other end of the first steel pipe pile, the pitch of the first helical fin and the pitch of the second helical fin being equal, and the first helical fin and second helical fin being continuous along an imaginary helix at the joint between the first steel pipe pile and the second steel pipe pile.

According to this configuration, the first helical fin of the first steel pipe pile and the second helical fin of the second steel pipe pile are equal in their fin pitches, and the first helical fin and second helical fin are continuous along an imaginary helix at the joint between the first steel pipe pile and the second steel pipe pile, whereby there is no disturbance of the surrounding ground during the installation that drives the steel pipe pile into the ground. As a result, the bearing capacity of the steel pipe pile can be enhanced.

The interval between the first helical fin and second helical fin can be an integral multiple of the pitch of the first helical fin or the pitch of the second helical fin.

At one end of the first steel pipe there can be further included a first cut region formed by cutting a part of the whole periphery of the first steel pipe that is a part of the periphery along the first helical fin and a second cut region formed by cutting a part of the whole periphery of the first steel pipe that is another part of the periphery other than the one part of the periphery so as to connect the beginning and end of the first cut region.

There can be further comprised a third helical fin formed helically on the inner periphery of the steel pipe to project from the same base as the base of the first helical fin in the direction opposite to the projecting direction of the first helical fin, with the first cut region being cut along the first helical fin and the third helical fin.

The first cut region can be cut at a predetermined distance from the first helical fin. Or the first cut region can be cut within the outer surface of the first helical fin.

At one end of the steel pipe, the thickness of one or both of the first helical fin and the steel pipe at least at the tip region of the first helical fin can be thicker than the thickness of other regions of the first helical fin or the steel pipe, respectively. Further, at one end of the steel pipe, the fin diameter of at least the tip region of the first helical fin can be greater than the fin diameter of the other portions of the first helical fin. In addition, at one end of the steel pipe, the first helical fin and the steel pipe at least at the tip region of the first helical fin can be fabricated by casting.

The second helical fin can project from its base to its distal end by a length different from the first helical fin.

Further, in order to overcome the aforesaid problems, in accordance with another aspect of the present invention, there is provided a steel pipe pile characterized by comprising a hollow first steel pipe; a first helical fin formed helically at a constantly equal pitch on the outer periphery of the first steel pipe; and a fourth helical fin formed helically at a constantly equal pitch on the outer periphery of the first steel pipe at a position apart from the first helical fin, the pitch of the first helical fin and the pitch of the fourth helical fin being equal, and the first helical fin and fourth helical fin being continuous along an imaginary helix.

According to this configuration, the first helical fin and the fourth helical fin formed on the outer periphery of the first steel pipe are equal in their fin pitches, and the first helical fin and fourth helical fin are continuous along an imaginary helix, so that the surrounding ground is not disturbed. As a result, the bearing capacity of the steel pipe pile can be enhanced.

The interval between the first helical fin and fourth helical fin can be an integral multiple of the pitch of the first helical fin or the pitch of the fourth helical fin.

The fourth helical fin can project from its base to its distal end by a length different from the first helical fin.

At one end of the first steel pipe can be further included a first cut region formed by cutting a part of the whole periphery of the first steel pipe that is a part of the periphery along the first helical fin and a second cut region formed by cutting a part of the whole periphery of the first steel pipe that is another part of the periphery other than the one part of the periphery so as to connect the beginning and end of the first cut region.

Any or all of the first to fourth helical fins can be made of steel bars.

There is provided a method of installing a steel pipe pile characterized by comprising a step of, at an embedding site, rotationally driving a first steel pipe pile that has a hollow first steel pipe and a first helical fin formed helically for at least one turn on the outer periphery of the first steel pipe from one end toward the other end of the first steel pipe at a constantly equal pitch; a step of regulating the driving speed when rotationally driving the first steel pipe pile into the ground so that the first helical fin of the first steel pipe pile passes along substantially the same path in the ground; a step of joining to the first steel pipe pile a second steel pipe pile that has a hollow second steel pipe and a second helical fin formed helically for at least one turn on the outer periphery of the second steel pipe from one end toward the other end of the second steel pipe at a constantly equal pitch and that is joined at an end to the other end of the first steel pipe pile, with the pitch of the first helical fin and the pitch of the second helical fin being equal, and the first helical fin and second helical fin being continuous along an imaginary helix at the joint between the first steel pipe pile and the second steel pipe pile; a step of, at the embedding site, rotationally driving the steel pipe pile obtained by joining the first steel pipe pile and the second steel pipe pile; and a step of regulating the driving speed when rotationally driving the steel pipe pile into the ground so that the first helical fin and second helical fin of the steel pipe pile pass along substantially the same path in the ground.

There is provided a method of installing a steel pipe pile characterized by comprising a step of, at an embedding site, rotationally driving a steel pipe pile comprising a hollow first steel pipe, a first helical fin formed helically at a constantly equal pitch on the outer periphery of the first steel pipe, and a fourth helical fin formed helically at a constantly equal pitch on the outer periphery of the first steel pipe at a position apart from the first helical fin, with the pitch of the first helical fin and the pitch of the fourth helical fin being equal, and the first helical fin and fourth helical fin being continuous along an imaginary helix; and a step of regulating the driving speed when rotationally driving the steel pipe pile into the ground so that the first helical fin and fourth helical fin of the steel pipe pile pass along substantially the same path in the ground.

Effect of the Invention

In accordance with the present invention, the bearing capacity of a pile can be ensured without disturbing the surrounding ground during installation.

MODES FOR CARRYING OUT THE INVENTION

Preferred embodiments of the present invention are explained in detail below with reference to the attached drawings. It should be noted that in the present description and drawings redundant explanation is avoided by assigning like symbols to constituent elements +having substantially the same functional configuration.

(First Embodiment)

Figure 1:
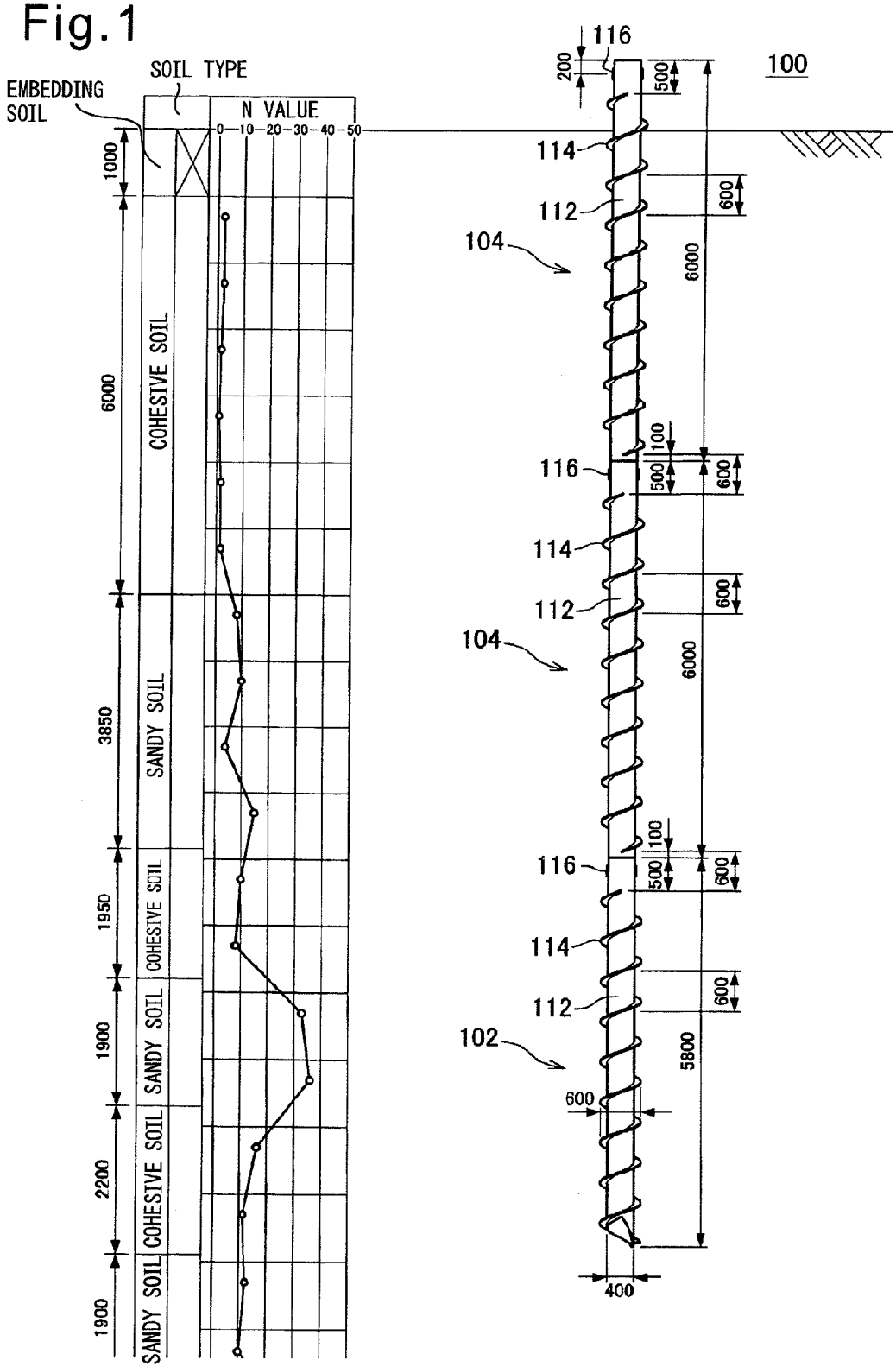
FIG. 1 is a side view showing a steel pipe pile 100 according to a first embodiment of the present invention.

The configuration of a steel pipe pile 100 according to a first embodiment of the present invention will be explained first with reference to FIG. 1. FIG. 1 is a side view showing the steel pipe pile 100 according to the present embodiment. FIG. 1 shows the state of the steel pipe pile 100 embedded in the ground.

The steel pipe pile 100 is installed in the ground to support the upper structure of a civil engineering structure such as a building, road, railway viaduct, abutment, pylon or the like. At this time, the steel pipe pile 100 is driven into the ground while being rotated using a rotary steel pipe pile driver such as, for example, a rotary all casing boring machine or a small crawler pile driver. The steel pipe pile 100 can be driven vertically with respect to a horizontal surface or be driven obliquely with respect to a horizontal surface at a prescribed angle in a direction other than vertical.

As shown in FIG. 1, the steel pipe pile 100 is composed of, for example, one lower pile 102 and multiple upper piles 104. The lower pile 102 is embedded with its cutaway-shaped tip downward and its upper end opposite to the tip connected to one end of an upper pile 104. The upper pile 104 is connected to one end of another upper pile 104 at its upper end opposite to the lower end connected to the lower pile 102. The lower pile 102 and the upper pile 104, and the two upper piles 104, are connected at the driving/installation site of the steel pipe pile 100 by, for example, welding or mechanical joining.

The length of the lower pile 102 and upper piles 104 can be freely decided in accordance with the steel pipe pile 100 to be driven into the ground. Although in FIG. 1 the length of the lower pile is 5800 mm and the length of the upper piles is 6000 mm, they are not limited to the example shown in FIG. 1. Further, the steel pipe pile 100 may in some cases consist of only the lower pile 102, and the number of upper piles 104 connected on top of the lower pile 102 may in some cases be one or three or more.

Figure 6:
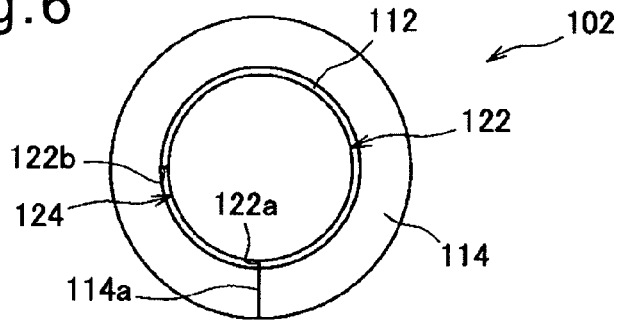
FIG. 6 is a bottom view showing the lower pile 102 of the steel pipe pile 100 according to the same embodiment.
Figure 7:
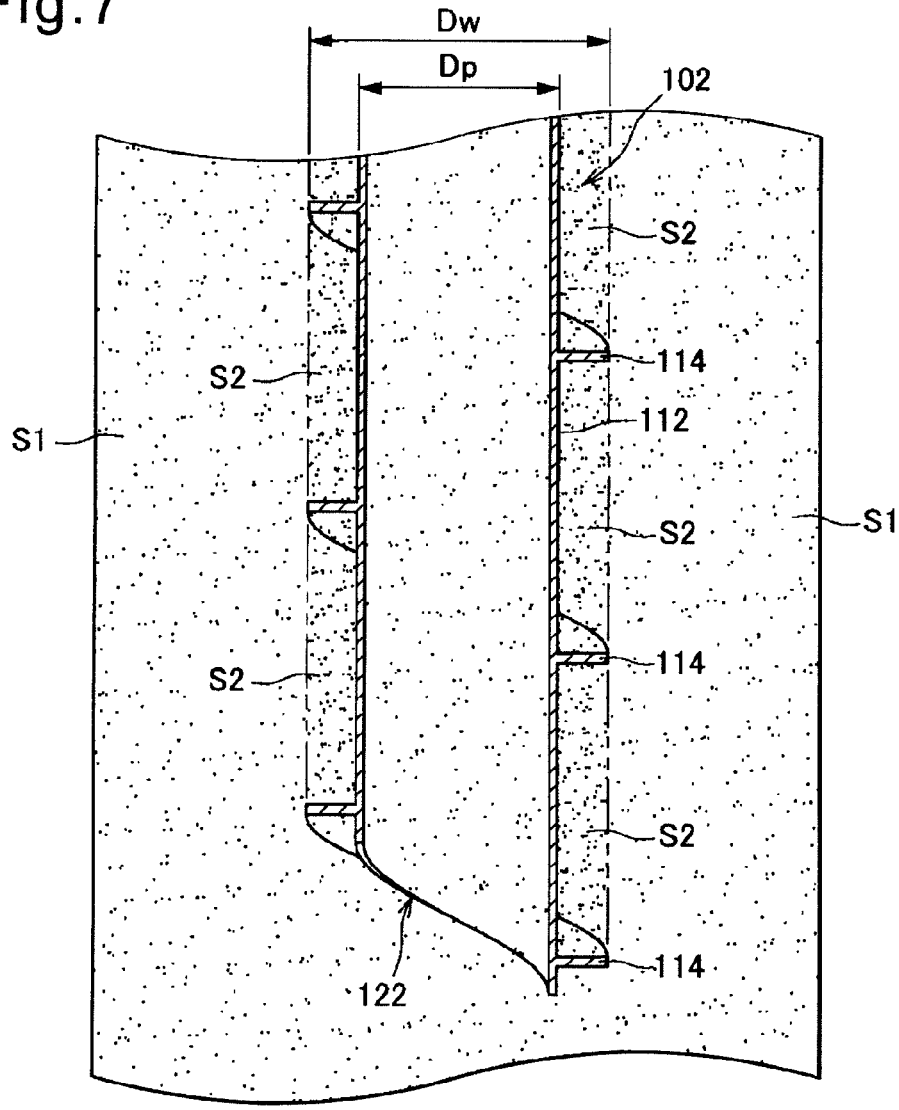
FIG. 7 is a sectional view showing the lower pile 102 of the steel pipe pile 100 according to the same embodiment.
Figure 8:
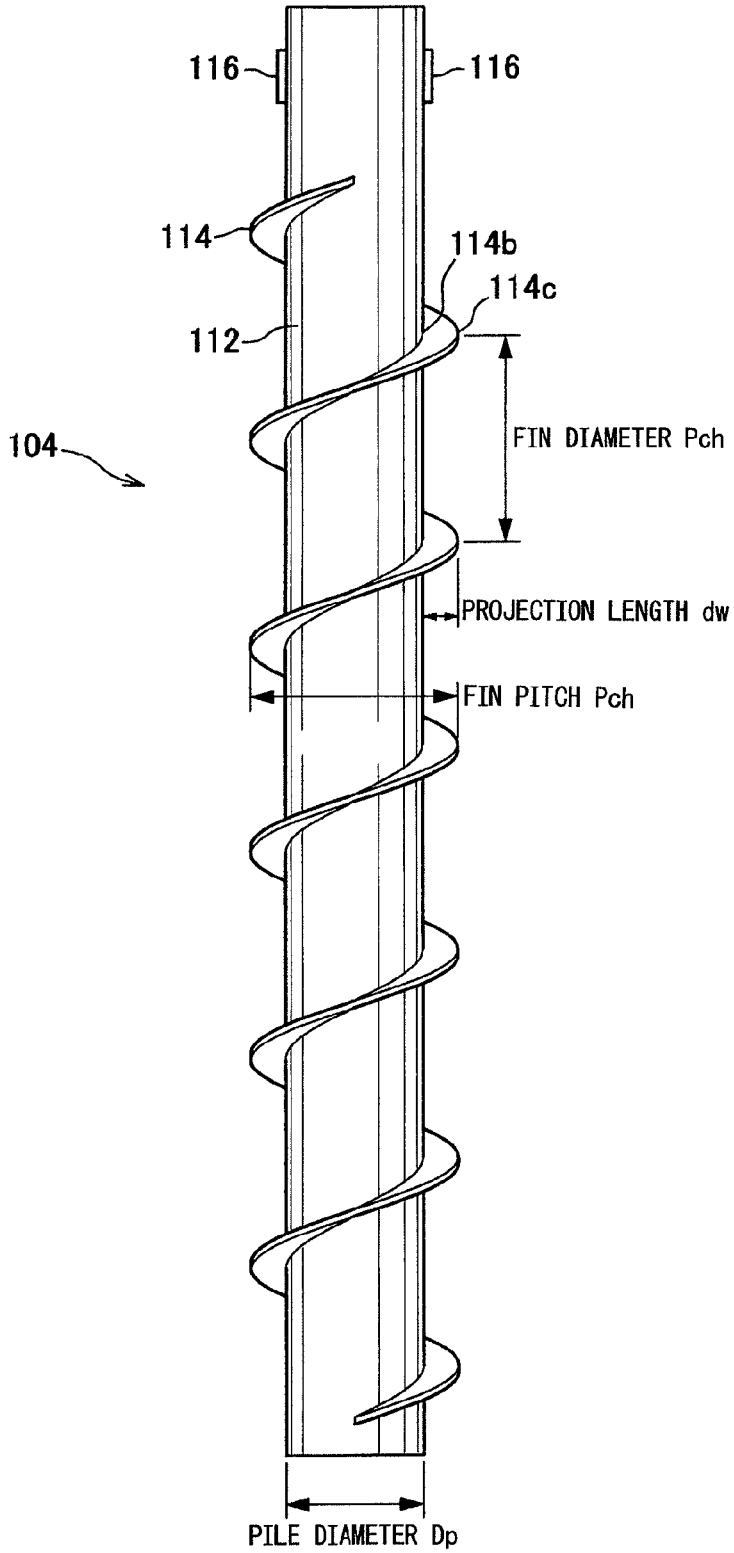
FIG. 8 is a side view showing the upper pile 104 of the steel pipe pile 100 according to the same embodiment.

Next, the lower pile 102 of the steel pipe pile 100 according to the present embodiment is explained with reference to FIGS. 2 to 7, and the upper pile 104 of the steel pipe pile 100 according to the present embodiment is explained with reference to FIG. 8.

Figure 2:
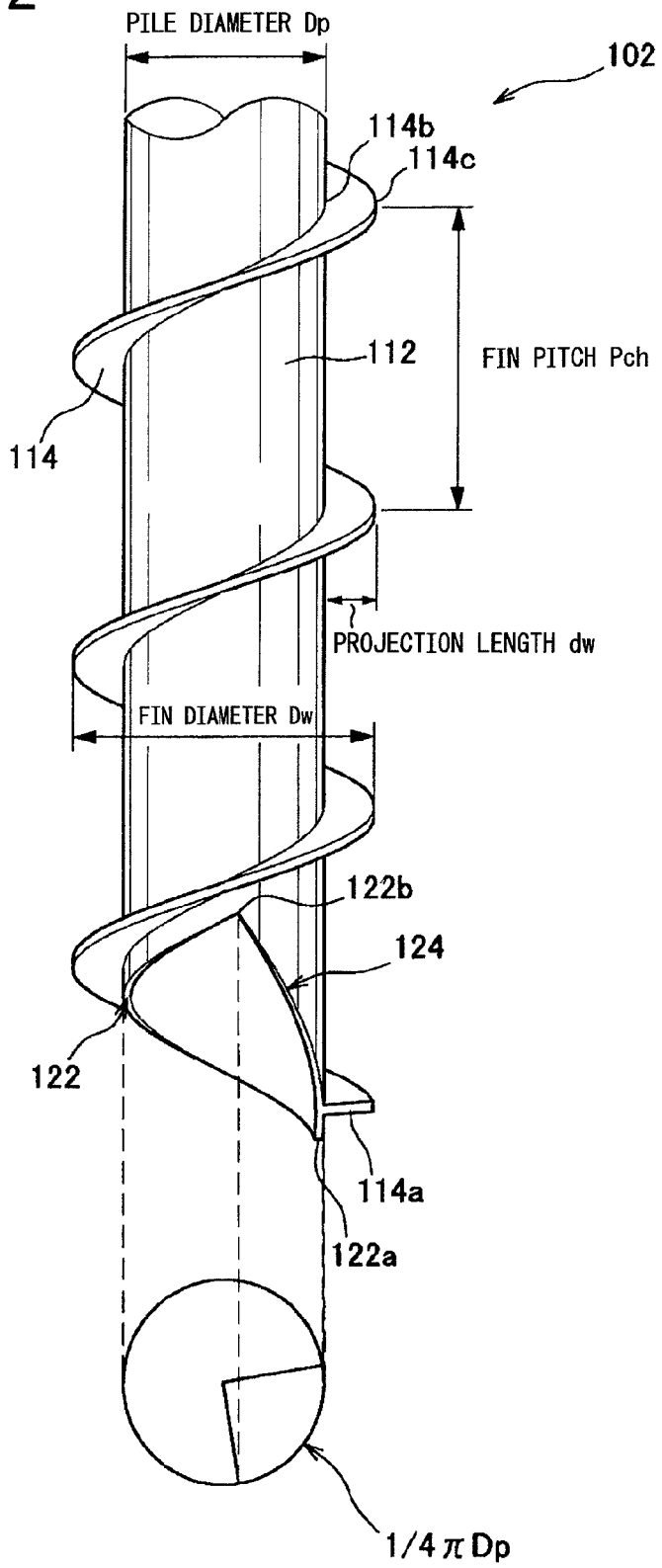
FIG. 2 is a side view showing the lower pile 102 of the steel pipe pile 100 according to the same embodiment.
Figure 3:
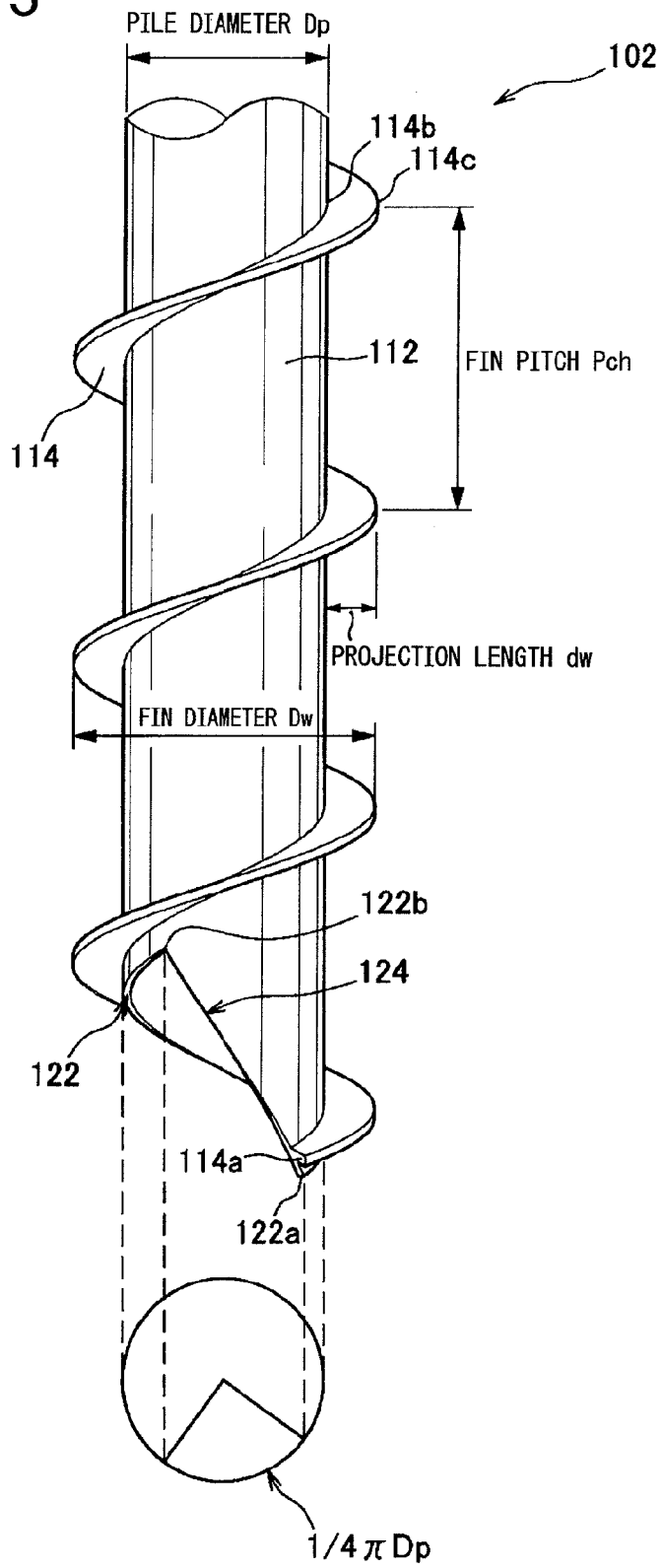
FIG. 3 is a side view showing the lower pile 102 of the steel pipe pile 100 according to the same embodiment.
Figure 4:
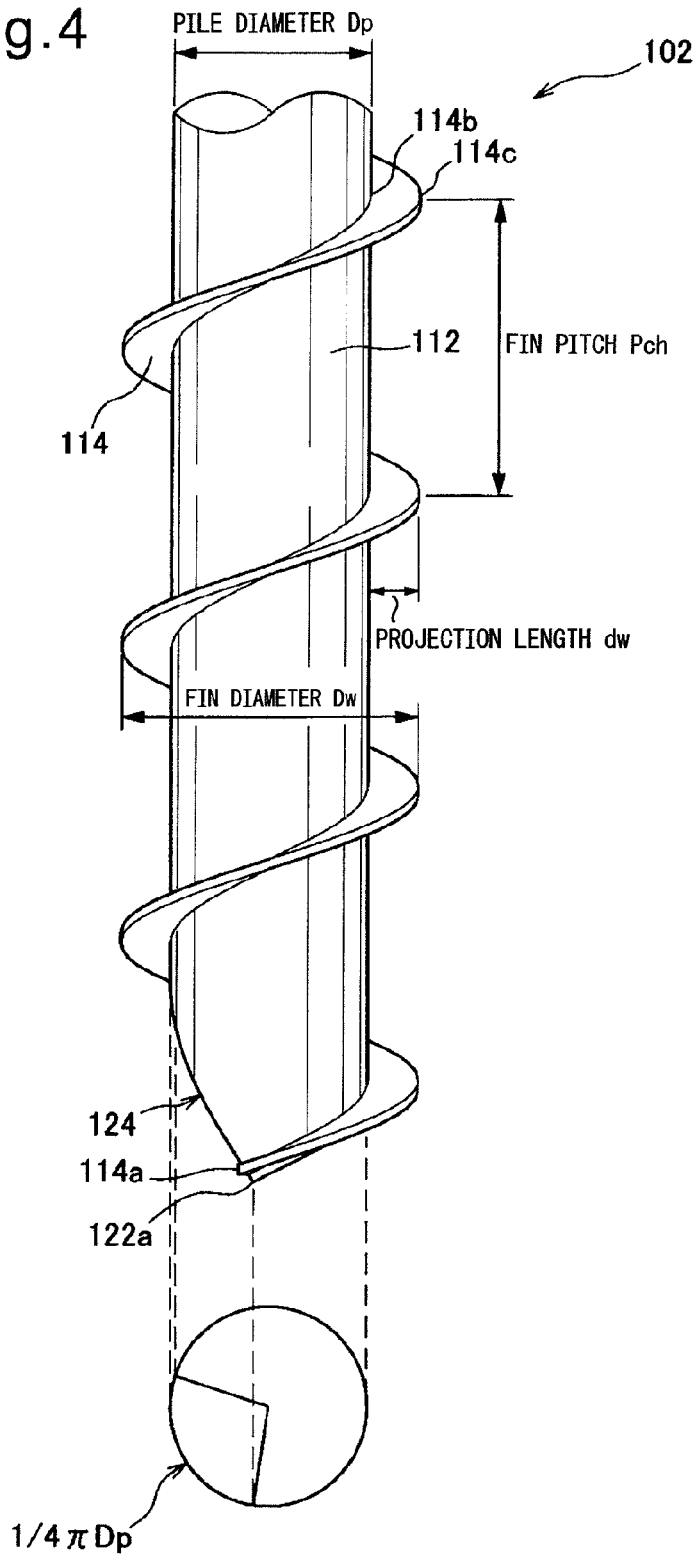
FIG. 4 is a side view showing the lower pile 102 of the steel pipe pile 100 according to the same embodiment.
Figure 5:
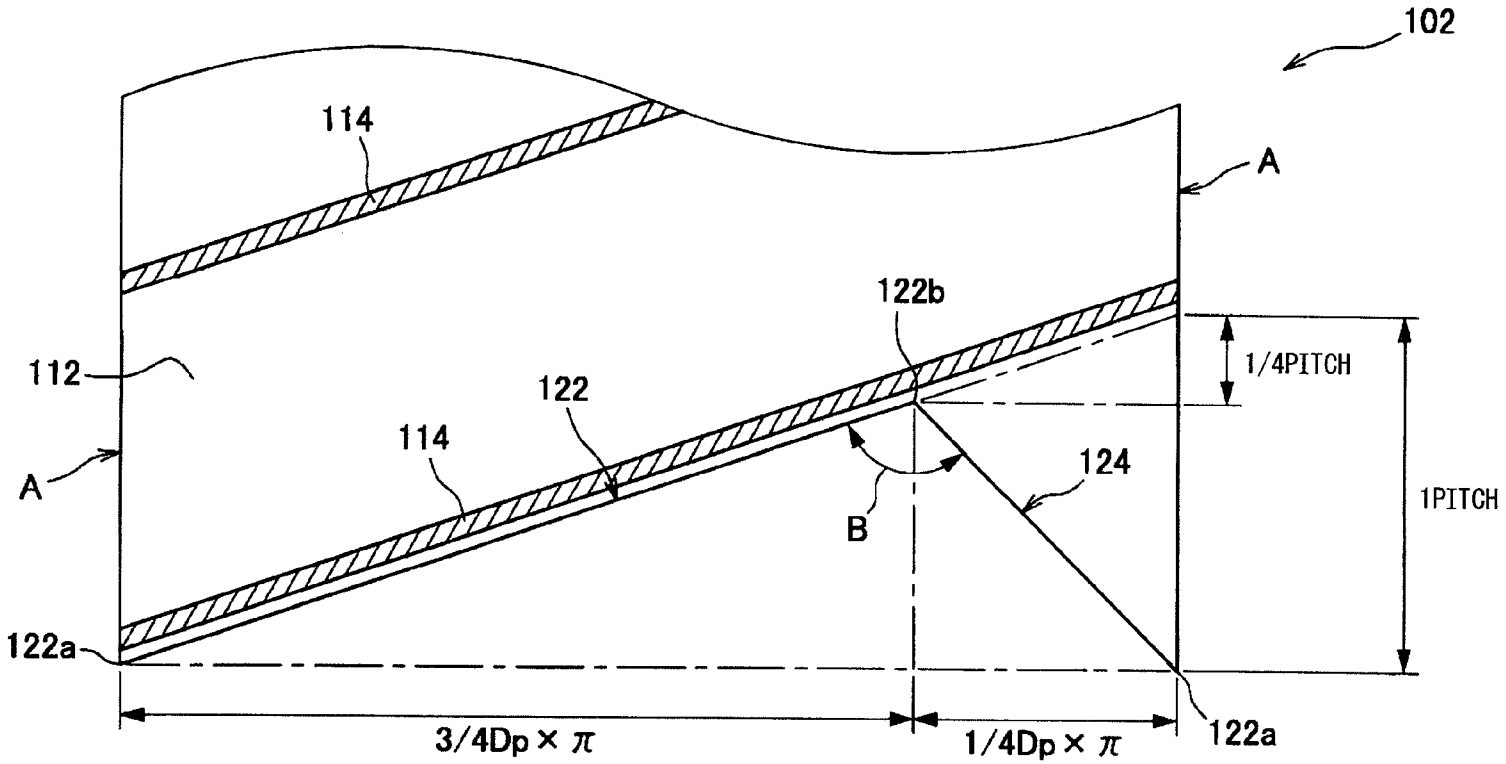
FIG. 5 is a developed view showing the lower pile 102 of the steel pipe pile 100 according to the same embodiment.

FIGS. 2 to 4 are side views showing the lower pile 102 of the steel pipe pile 100 according to the present embodiment. FIGS. 2 to 4 are diagrams showing respective side surfaces of the same lower pile 102 as viewed from different directions. FIG. 5 is a developed view showing the lower pile 102 of the steel pipe pile 100 according to the present embodiment. FIG. 5 is developed view of the lower pile 102 cut along a line A parallel to the axis of the lower pile 102. FIG. 6 is a bottom view showing the lower pile 102 of the steel pipe pile 100 according to the present embodiment. FIG. 7 is a sectional view showing the lower pile 102 of the steel pipe pile 100 according to the present embodiment. FIG. 7 is a view showing the lower pile 102 cut in the axial direction. FIG. 8 is a side view showing the upper pile 104 of the steel pipe pile 100 according to the present embodiment.

The lower pile 102 comprises, inter alia, a steel pipe 112, helical fin 114, fitting 116, first cut region 122, and second cut region 124. The upper pile 104 comprises, inter alia, a steel pipe 112, helical fin 114, and fitting 116.

The steel pipe 112 is, for example, a hollow round pipe. In the example shown in FIG. 1, the case is shown where the pile diameter Dp, i.e., the steel pipe diameter, is 400 mm. It should be noted that the pile diameter Dp is not limited to the example shown in FIG. 1, but is of a size of 40 mm to 1200 mm, the size being determined in accordance with the strength design and the like of the structure.

The helical fin 114 is a plate-like member formed on the outer periphery of the steel pipe 112 to extend continuously from one end to the other end of the steel pipe 112 helically for at least one turn at a constantly equal pitch. Owing to the provision of the helical fin 114, greater propelling force can be imparted to the lower pile 102 and upper pile 104 than when a helical fin is provided only at the tip of the steel pipe pile 100. Further, as pointed out below, the fin diameter Dw can be considered the outside diameter of the pile required for calculating the bearing capacity attributable to frictional force, and since the pile outside diameter can be made thicker by the helical fin 114, no enlarging of steel pipe diameter is necessary for increasing bearing capacity. As a result, the amount of steel needed to fabricate the steel pipe pile 100 can be reduced.

In order to make it possible for the fin diameter Dw to be considered the outside diameter of the pile which is necessary for calculating the bearing capacity attributable to frictional force, ratio Pch/dw of the fin pitch Pch to the fin projection length dw must satisfy $Pch/dw \leq 24$. When Pch/dw is greater than 24, it becomes impossible to assess the frictional force at the cylindrical surface whose diameter is the fin profile and the outside of the cylinder surface comes to be strongly affected by the earth, with the result that such disadvantages arise as that the fin thickness becomes great and the variance in bearing capacity increases.

As regards the helical fin 114, a short side of the plate portion of the helical fin 114 is joined to the steel pipe 112. The joint between the steel pipe 112 and helical fin 114 is, for example, made by welding. The helical fin 114 can be formed, for example, by winding on and welding a steel bar. The helical fin 114 projects from its base 114*b*, i.e., the region of its joint to the steel pipe 112, to its distal end 114*c*, and the fin projection length dw plus the pile diameter Dp, i.e., the outside diameter, is designated fin diameter Dw. In the example shown in FIG. 1, there is shown the case where the fin diameter Dw is 600 mm. It should be noted that the fin diameter Dw is not limited to the example shown in FIG. 1, but is of a size of, for example, 1.2 Dp to 1.5 Dp, and in some cases may be given a size up to 2.0 Dp. Increasing the fin diameter Dw, such as to 1.5 Dp, makes it possible increase the propelling force when driving the lower pile 102 and upper pile 104 into the ground.

Where the distance between adjacent turns of the helical fin 114 when the helical fin 114 has made one turn around the outer periphery of the steel pipe 112 is defined as the fin pitch Pch, the example indicated in FIG. 1 shows the case where the fin pitch Pch is 600 mm. As pointed out later, it is better to give the lower pile 102 and the upper pile 104 the same fin pitch Pch. It should be noted that the fin pitch Pch is not limited to the example shown in FIG. 1, and, for example, can be made 0.6 to 2.0 Dw, but is preferably 0.6 to 1.2 Dw. However, if the fin pitch Pch is too large, driving and installation substantially in conformity with the fin pitch may become difficult. Further, it is also conceivable that the load acting per fin turn under the application of vertical force may become too large. In some cases, therefore, it is better not to expand the fin pitch Pch too much in line with the size of the fin diameter Dw (pile diameter Dp). It should be noted that when the fin pitch Pch is too small, the amount of steel material increases, so that the fin pitch Pch can be determined by the balance between the obtainable propelling force and the amount of steel material.

The fitting 116, although not explained in detail here, is a component attached to project from the outer periphery of the steel pipe 112 and has a shape corresponding to its purpose as, for example, a hanger piece or a stud for steel pipe rotation. As a hanger piece, the fitting 116 is used in the case of suspending the lower pile 102 or upper pile 104 with a crane or the like and mounting the lower pile 102 or upper pile 104 on a rotary steel pipe pile driver. Further, as a stud for steel pipe rotation, when the lower pile 102 or upper pile 104 is driven into the ground with a rotary steel pipe pile driver, the fitting 116 is used to transmit the torque of the rotary steel pipe pile driver to the lower pile 102 or upper pile 104. It should be noted that the fitting is not limited to the case of attaching it to the outer periphery of the steel pipe 112 as an external fitting. As an internal fitting, it can be attached to the inner peripheral surface of the steel pipe 112 to project inward. The provision of the fitting on the inner peripheral surface of the steel pipe 112 makes it possible to shorten the length of the region where no helical fin 114 is provided from the upper or lower end of the lower pile 102 or upper pile 104 up to the end of helical fin 114 attachment.

The first cut region 122 is formed at one end of the steel pipe 112 by cutting part of the whole peripheral length of the steel pipe 112 along the helical fin 114. The portion of the first cut region 122 located at the end of the lower pile 102 at this time is designated the beginning point 122*a* and the end of the first cut region 122 opposite to the beginning point 122*a* is designated the end point 122*b*. Further, as shown in FIGS. 2 to 5 and FIG. 7, the first cut region 122 of the present embodiment is cut to be spaced a prescribed distance from the helical fin 114 toward the lower end of the lower pile 102.

The second cut region 124 is formed at one end of the steel pipe 112 by cutting a part of the whole periphery of the steel pipe 112 that is a part other than the part forming the first cut region 122 so as to connect the beginning point 122*a* and end point 122*b* of the first cut region 122.

In the example shown in FIGS. 1 to 7, the first cut region 122 occupies a ¾ Dp×π it peripheral length section of the whole length (Dp×π) of the steel pipe 112, and the second cut region 124 occupies a ¼ Dp×π peripheral length section of the whole length (Dp×π) of the steel pipe 112.

The angle formed between the first cut region 122 and the second cut region 124 when the lower pile 102 is developed as shown in FIG. 5 is the angle B as shown in the drawing. Since the apex of the angle is near the helical fin 114, the angle B varies depending on the position of the apex of the angle (i.e., the peripheral lengths occupied by the first cut region 122 and second cut region 124). At the time of driving the steel pipe pile 100 into the ground, the durability can be increased more in the case where the angle B is obtuse than the case where it is acute.

Figure 9:
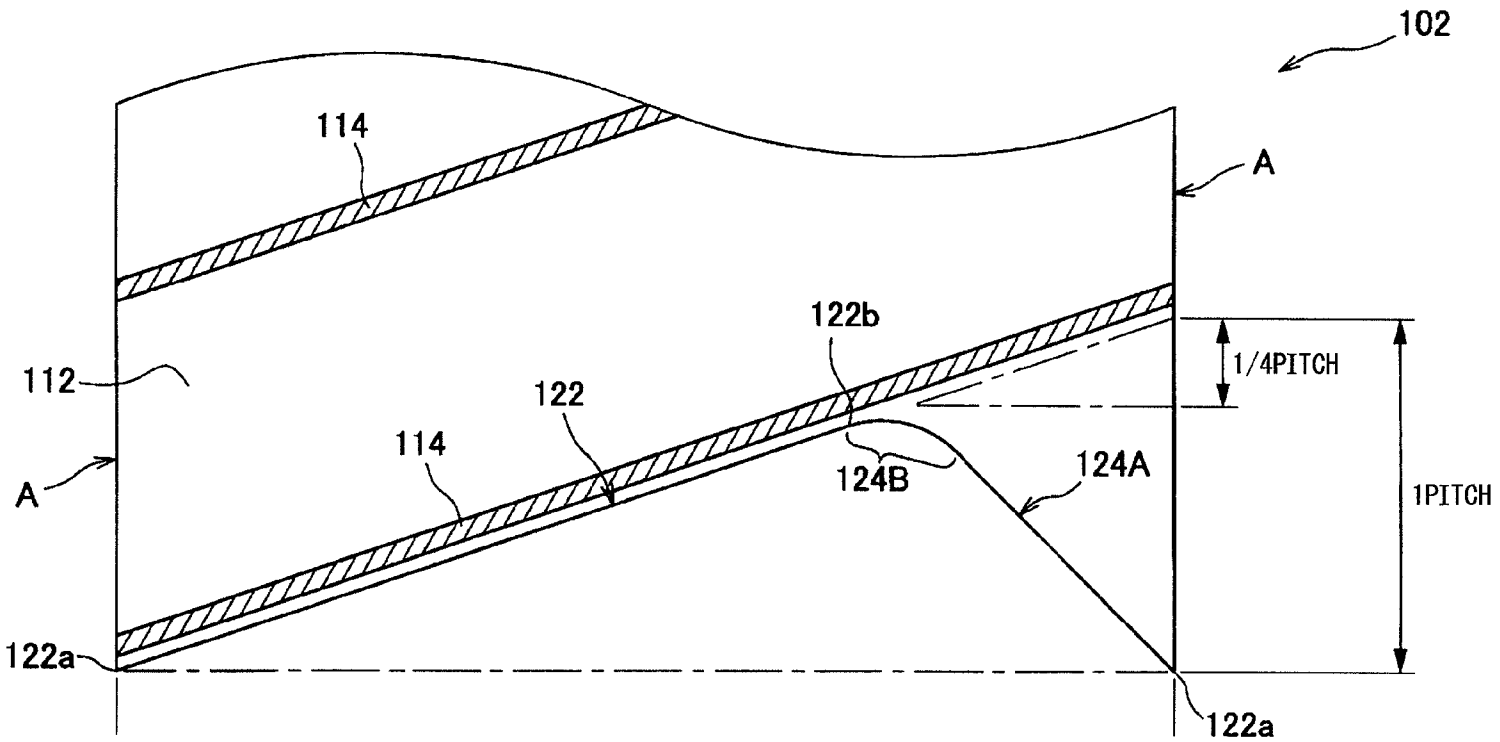
FIG. 9 is a developed view showing a modification of the lower pile 102 of the steel pipe pile 100 according to the same embodiment.

It should be noted that while in FIG. 5 an example is shown in which the intersection point (122*b*) of the first cut region 122 and the second cut region 124 has an apex, the present invention is not limited to this example. For example, as shown in FIG. 9, it is possible to constitute the second cut region 124 of a straight line portion 124A and a curved portion 124B and give the section near the intersection point (122*b*) of the first cut region 122 and second cut region 124 a smoothly continuous shape. FIG. 9 is a developed view showing a modification of the lower pile 102 of the steel pipe pile 100 according to the first embodiment of the present invention. By this it is possible to disperse the force acting at the intersecting region of the first cut region 122 and second cut region 124, whereby the strength of the tip region of the lower pile 102 can be improved.

Figure 22:
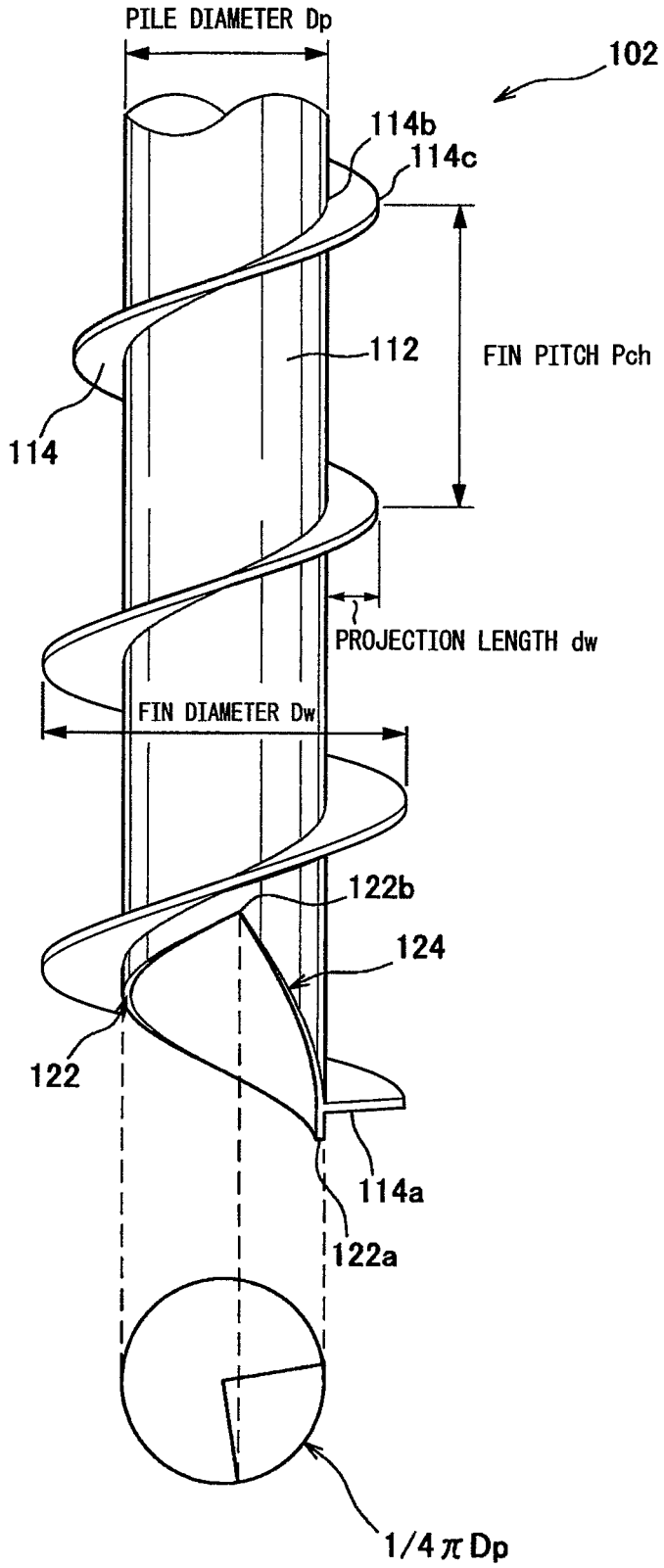
FIG. 22 is a side view showing the lower pile 102 of the steel pipe pile 100 according to an embodiment.

When the steel pipe pile 100 is driven into the ground, the second cut region 124 and the tip 114*a* of the helical fin 114 enter the ground first. The steel pipe pile 100 is then progressively driven into the ground by the driving force of the rotary steel pipe pile driver and the propelling force of the helical fin 114. At this time, as shown in FIG. 7, earth also progressively enters into the interior of the hollow lower pile 102 and upper pile 104. A larger propelling force can be obtained and the driving of the steel pipe pile can be facilitated by making the fin diameter of at least one turn of the helical fin at the steel pipe tip larger than the fin diameter at the other regions, as shown in FIG 22.

Thus, thanks to the tip of the lower pile 102 having the cutaway shape of the steel pipe 112 and the steel pipe 112 being hollow, the steel pipe pile 100 is improved in drivability compared to the case where the pile tip has a closed shape. Moreover, because of the good drivability, the tip region can be formed with a simple shape to ensure the required strength in the steel pipe pile. In addition, owing to the simple shape of the tip region, the machining of the cut configurations is relatively easy, whereby the machining cost can be reduced.

Figure 10:
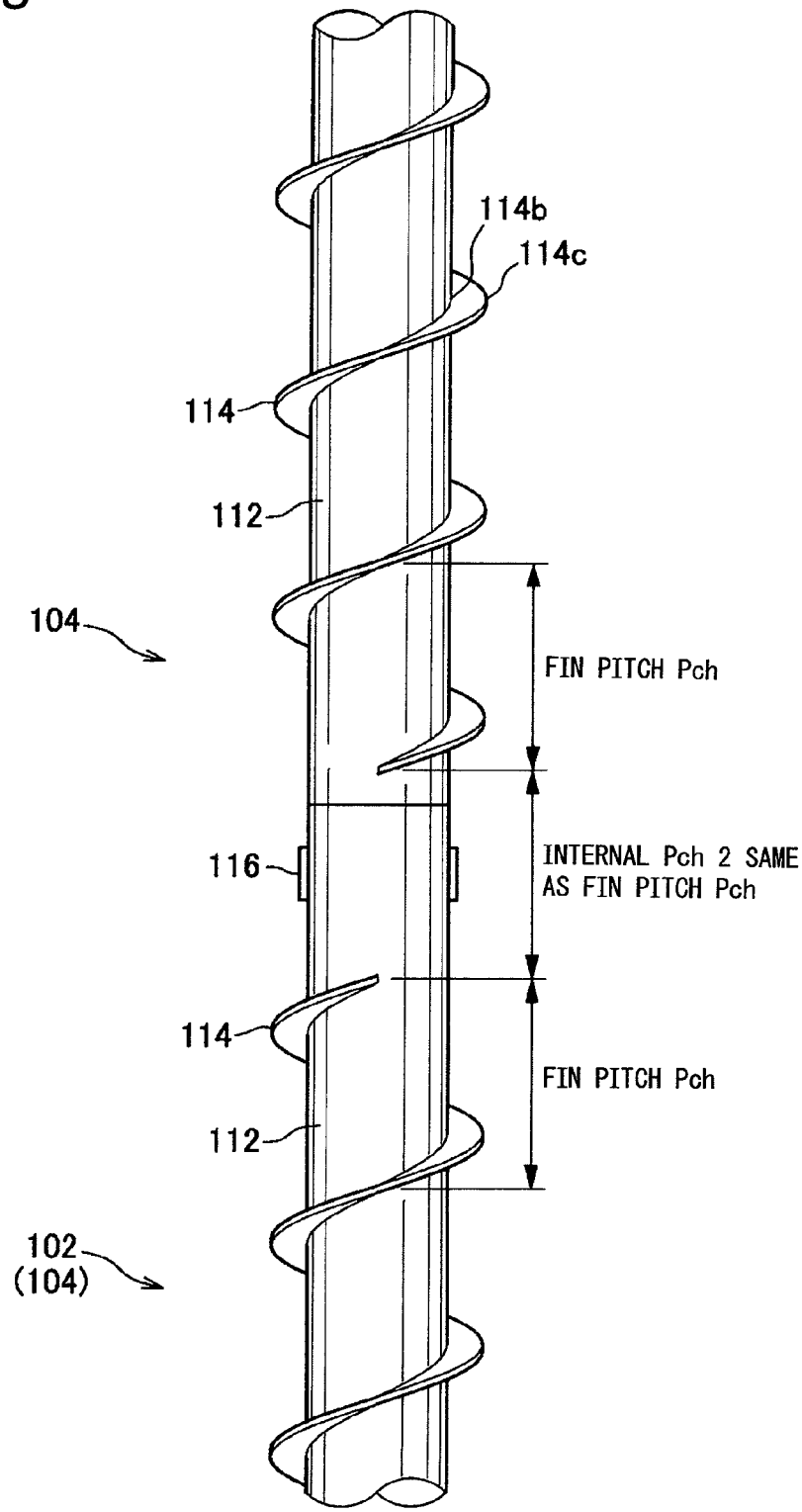
FIG. 10 is a side view showing the lower pile 102 and upper pile 104 of the steel pipe pile 100 according to the same embodiment.

Next, explanation will be given with reference to FIG. 10 regarding the joining of the lower pile 102 and the upper pile 104, and the joining between the upper piles 104. FIG. 10 is a side view showing the lower pile 102 and upper pile 104 of the steel pipe pile 100 according to the present embodiment.

As regards the lower pile 102 and upper pile 104, the upper end of the lower pile 102 and the lower end of the upper pile 104 are joined by, for example, welding or mechanical joining. Further, as regards two upper piles 104, the upper end of one upper pile 104 and the lower end of the other 104 are joined by, for example, welding or mechanical joining.

At this time, as shown in FIG. 10, the helical fin 114 is sometimes not provided at the upper end of the lower pile 102, and the upper end and lower end of the upper pile 104, so as to reach to as far as the extremity. Even in such a case, the helical fin 114 of the lower pile 102 (upper pile 104) and the helical fin 114 of the upper pile 104 should be continuously connected along an imaginary helix. In other words, the interval between the terminus of the helical fin 114 of the lower pile 102 (upper pile 104) and the terminus of the helical fin 114 of the upper pile 104 assumes the same, or an integral multiple of, the fin pitch Pch of the lower pile 102 and upper pile 104. As a result, the fin pitches Pch of the lower pile 102 and upper pile 104 are equal and the helical fin 114 of the lower pile 102 (upper pile 104) and the helical fin 114 of the upper pile 104 are continuous. Further, when the lower pile 102 and upper pile 104 are rotationally driven, the driving speed is regulated so that the helical fins 114 are installed in the ground in conformity with the fin pitch Pch (allowance of fin pitch plus or minus about 10%), i.e., so that the helical fins 114 pass along substantially the same path in the ground.

As a result, when the steel pipe pile 100 is driven into the ground, the helical fins 114 always pass through the same places in the ground. Therefore, the ground S2 is firmly packed between the helical fins 114 without disturbing the ground S2 between the helical fins 114. Moreover, the earth shear strength between the ground S1 around the steel pipe pile 100 and the firmly packed ground S2 between the helical fins 114 enables the steel pipe pile 100 to support a load from above. At this time, the bearing capacity can be calculated assuming the fin diameter Dw to be the outside diameter of the steel pipe pile 100.

(Second Embodiment)

Next, a steel pipe pile 200 according to a second embodiment of the present invention will be explained.

Figure 11:
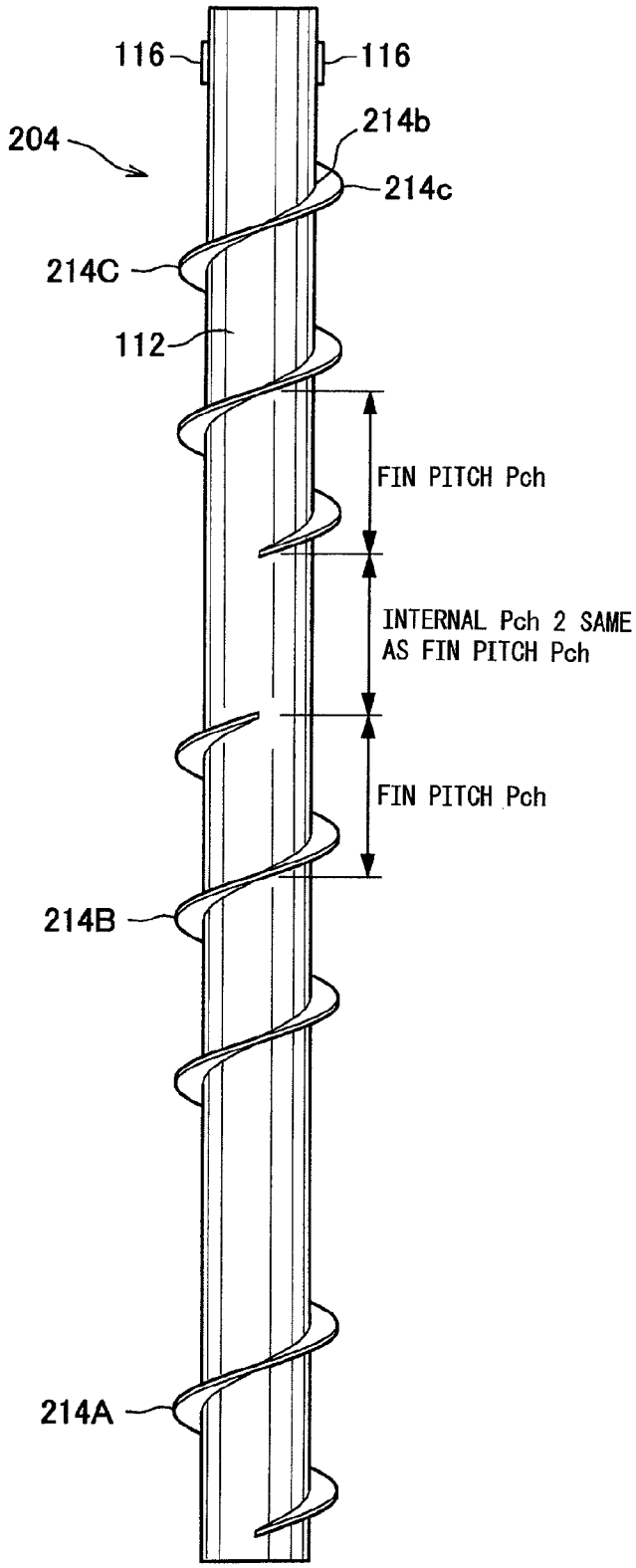
FIG. 11 is a side view showing the upper pile 204 of a steel pipe pile 200 according to a second embodiment of the present invention.

The steel pipe pile 200 is composed of, for example, an upper pile 204 and a lower pile (not shown). As shown in FIG. 1 and FIG. 8, in the foregoing first embodiment the lower pile 102 and upper pile 104 each has a single helical fin 114 formed on the outer peripheral surface of the steel pipe 112 continuously from near one end to near the other end, but the present embodiment differs in the formation of helical fins 214A, 214B and 214C. The upper pile 204 of the steel pipe pile 200 according to the present embodiment is explained below with reference to FIG. 11. FIG. 11 is a side view showing the upper pile 204 of the steel pipe pile 200 according to the second embodiment of the present invention.

The upper pile 204 comprises, inter alia, a steel pipe 112, helical fins 214A, 214B and 214C, and a fitting 116. A detailed explanation of the steel pipe 112 and fitting 116 is omitted because they are the same as in the first embodiment.

Multiple helical fins are provided on the upper pile 204; in the example shown FIG. 11, the three helical fins 214A, 214B and 214C are provided. The helical fins 214A, 214B and 214C are formed on the outer peripheral surface of the steel pipe 112 to be mutually spaced from one another. The helical fins 214A, 214B, and/or 214C can be formed, for example, by winding on and welding steel bars. At this time, the helical fins 214A, 214B and 214C of the upper pile 204 should be arranged to have the same pitch and be continuous along imaginary helices. In other words, the helical fins 214A, 214B and 214C are arranged so that the intervals between the termini of the helical fins 214A, 214B and 214C of the upper pile 204 assume the same, or integral multiples of, the fin pitches Pch of the helical fins 214A, 214B and 214C.

As a result, when the fin pitches Pch of the helical fins 214A, 214B and 214C are equal, the helical fins 214A, 214B and 214C of the upper pile 204 are continuous along imaginary helices. Further, when the upper pile 204 is rotationally driven, the driving speed is regulated so that the helical fins 214A, 214B and 214C are installed in the ground substantially in conformity with the fin pitch Pch (allowance of fin pitch plus or minus about 10%), i.e., so that the helical fins 214A, 214B and 214C pass along substantially the same path in the ground.

As a result, when the steel pipe pile 200 is driven into the ground, the helical fins 214A, 214B and 214C always pass through the same places in the ground. As a result, the ground S2 is firmly packed between the helical fins 214A, 214B and 214C without disturbing the ground S2 between the helical fins 214A, 214B and 214C. Although an example of the upper pile 204 is shown in FIG. 11, it should be noted that this modification can be similarly applied to the lower pile.

The unshown lower pile is provided with multiple helical fins similar to the helical fins 214A, 214B and 214C of the upper pile 204. The upper pile 204 and lower pile are joined by welding. It should be noted that although the aforesaid steel pipe pile 200, upper pile 204 and lower pile all comprise multiple helical fins, the present invention is not limited to these examples. For example, it is possible to configure a steel pipe pile such as by combining the lower pile 102 of first embodiment and the upper pile 204 of the present embodiment or by combining the lower pile of the present embodiment and the upper pile 104 of the first embodiment.

(Third Embodiment)

Figure 12:
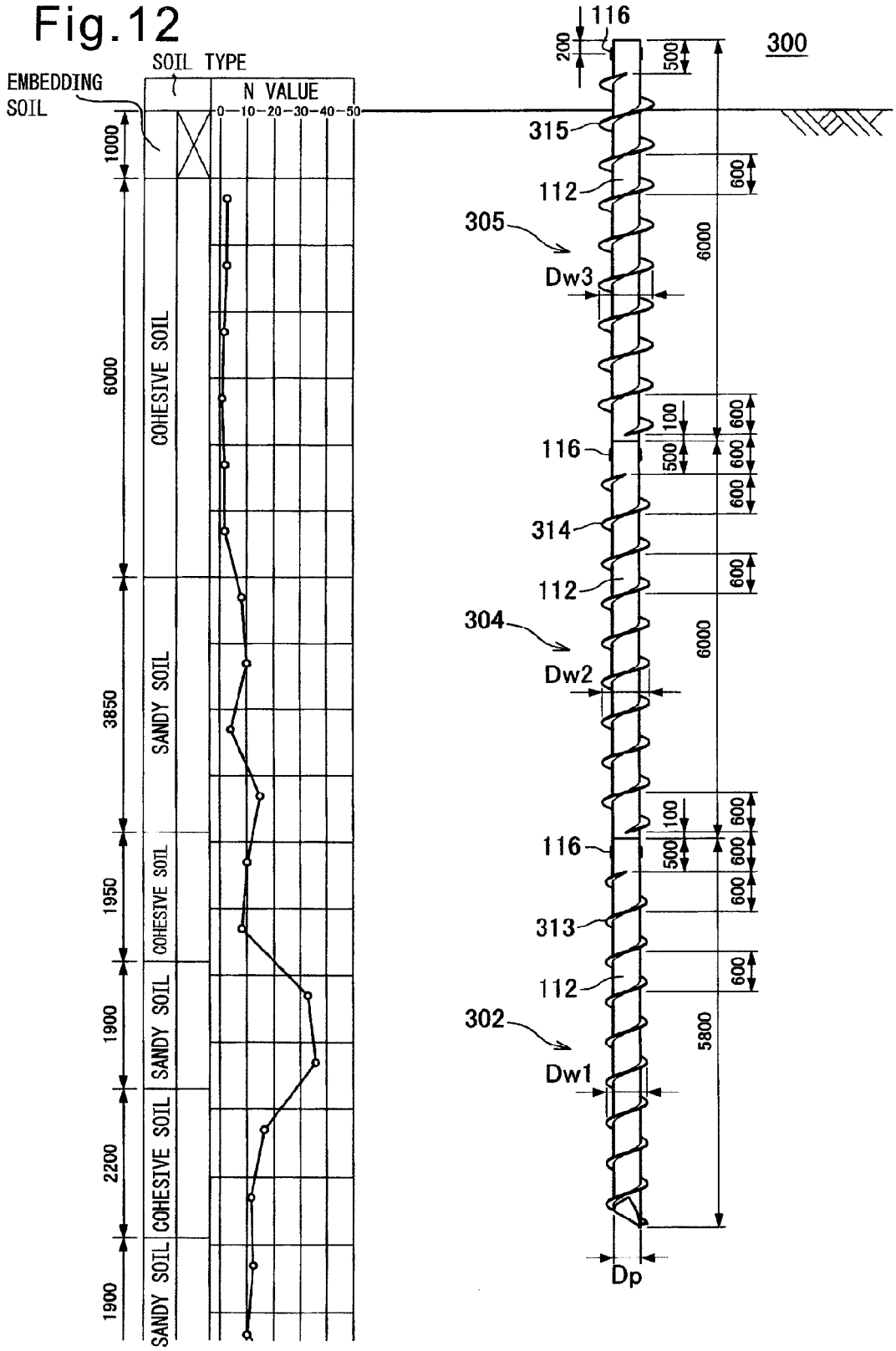
FIG. 12 is a side view showing the upper pile 204 of a steel pipe pile 300 according to a third embodiment of the present invention.

Next, a steel pipe pile 300 according to a third embodiment of the present invention will be explained with reference to FIG. 12. The steel pipe pile 300 differs from the steel pipe pile 100 of the first embodiment in the configuration of the helical fin 114. FIG. 12 is a side view showing the steel pipe pile 300 according to the present embodiment. The FIG. 12 shows the state of the steel pipe pile 300 embedded in the ground.

As shown in FIG. 12, the steel pipe pile 300 is composed of, for example, one lower pile 302 and upper piles 304 and 305. Like the lower pile 102 and upper pile 104, the lower pile 302 comprises, inter alia, a steel pipe 112, helical fin 313, fitting 116, first cut region 122, and second cut region 124. The upper pile 304 comprises, inter alia, a steel pipe 112, helical fin 314, and fitting 116, and the upper pile 305 comprises, inter alia, a steel pipe 112, helical fin 315, and fitting 116. The helical fins 313, 314 and 315 can be formed, for example, by winding on and welding steel bars.

The helical fin 313 of the lower pile 302 has a fin diameter Dw1, the helical fin 314 of the upper pile 304 has a fin diameter Dw2, and the helical fin 315 of the upper pile 305 has a fin diameter Dw3. The fin diameter Dw2 is larger than the fin diameter Dw1, and the fin diameter Dw3 is larger than the fin diameter Dw2. The pile diameter Dp and fin pitch are the same among all of the lower pile 302 and upper piles 304 and 305. Further, the helical fin 313 of the lower pile 302, and the helical fins 314, 315 of the upper piles 304 and 305 are continuously connected along imaginary helices.

The example shown in FIG. 12 is a case where the fin diameter is changed in accordance with the ground strength (N value) in the depth direction of the ground. As a result of installing the steel pipe pile 300, the helical fin 313 of relatively small fin diameter is positioned at a depth of high ground strength, and the helical fins 314 and 315 of relatively large fin diameter are positioned at depths of low ground strength. By changing the size of the helical fins 313, 314 and 315 to modify the fin diameters in accordance with, for example, the ground strength in the depth direction of the ground in this manner, bearing capacity matched to the ground can be ensured. Further, owing to the reduction of the fin diameter at the region of high ground strength, the force acting on the helical fin 313 from above can be decreased to make it possible to make the thickness of the helical fin 313 thin in comparison to the case where the fin diameter is large. Moreover, installation performance can be improved because making the fin diameter small lowers the frictional force in the ground during installation.

In accordance with present embodiment, the fin diameters Dw1, Dw2 and Dw3 can be considered the outside diameters of the pile 300, and the outer peripheral surface area of the steel pipe pile 300 required for calculating the bearing capacity of the steel pipe pile 300 can be calculated based on the fin diameters Dw1, Dw2 and Dw3. Moreover, the outer peripheral surface area of the steel pipe pile 300 can be expanded and the bearing capacity can be improved merely by enlarging the fin diameter without thickening the actual pile diameter Dp. Therefore, as compared with the case of expanding the outer diameter by increasing the pile diameter in a steel pipe pile with no helical fins, the steel pipe pile 300 of the present embodiment can reduce the amount of steel plate needed to fabricate the steel pipe pile and achieve high bearing capacity with less material.

It should be noted that although an example was given in which the fin diameters at the lower pile 302 is constant and those at upper piles 304 and 305 are constant respectively but the fin diameter differs between the piles, the present invention is not limited to this example. For example, it is also possible for the lower pile or upper piles to have a configuration wherein the fin diameter changes at an intermediate region of the lower pile or upper piles. Further, although an example was explained in which the fin diameter increases from the bottom toward the top of the steel pipe pile 300, the present invention is not limited to this example. It is also possible for the upper pile at the top of the steel pipe pile 300 to be smaller in fin diameter than the upper pile or lower pile at the bottom.

(Modifications of the First to Third Embodiments)

Next, a lower pile 402 according to a first modification of the first to third embodiments of the present invention will be explained with reference to FIGS. 13 to 16.

Figure 13:
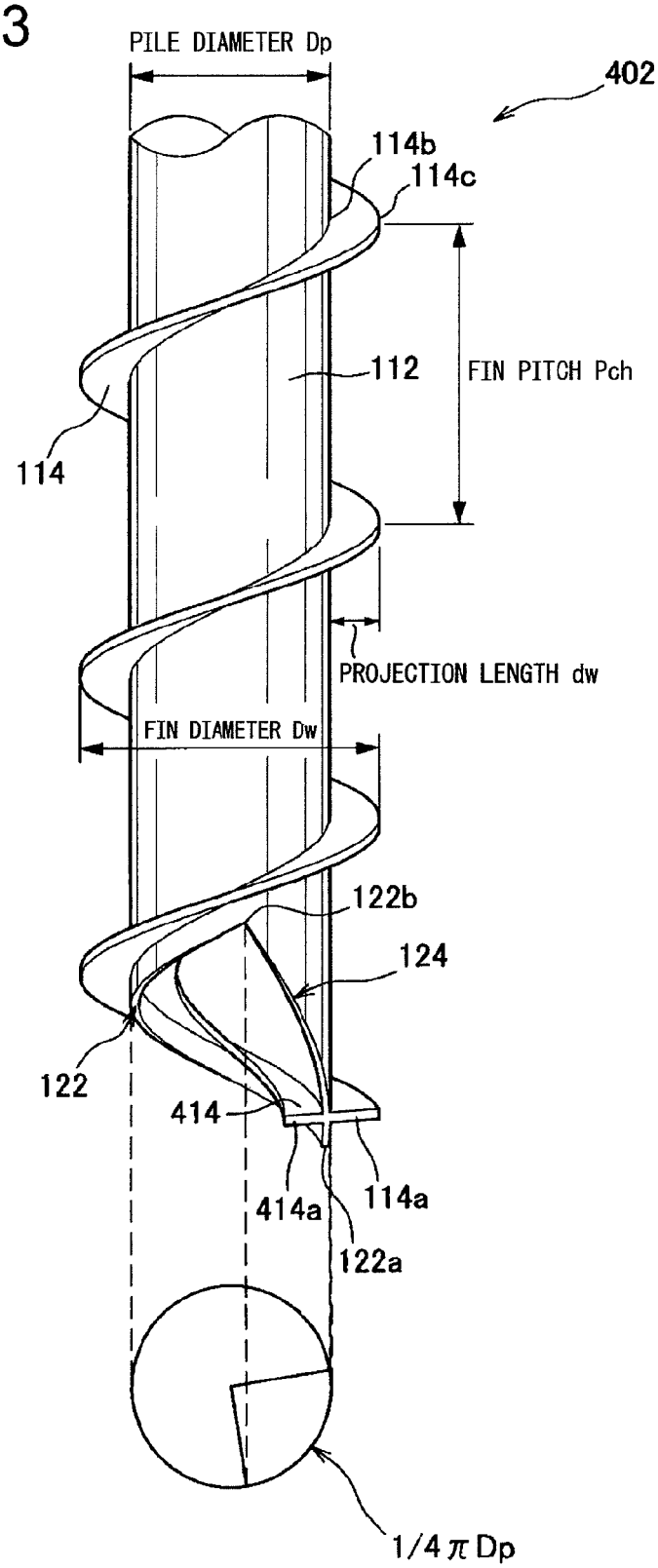
FIG. 13 is a side view showing the lower pile 402 according to a first modification of the first to third embodiments of the present invention.
Figure 14:
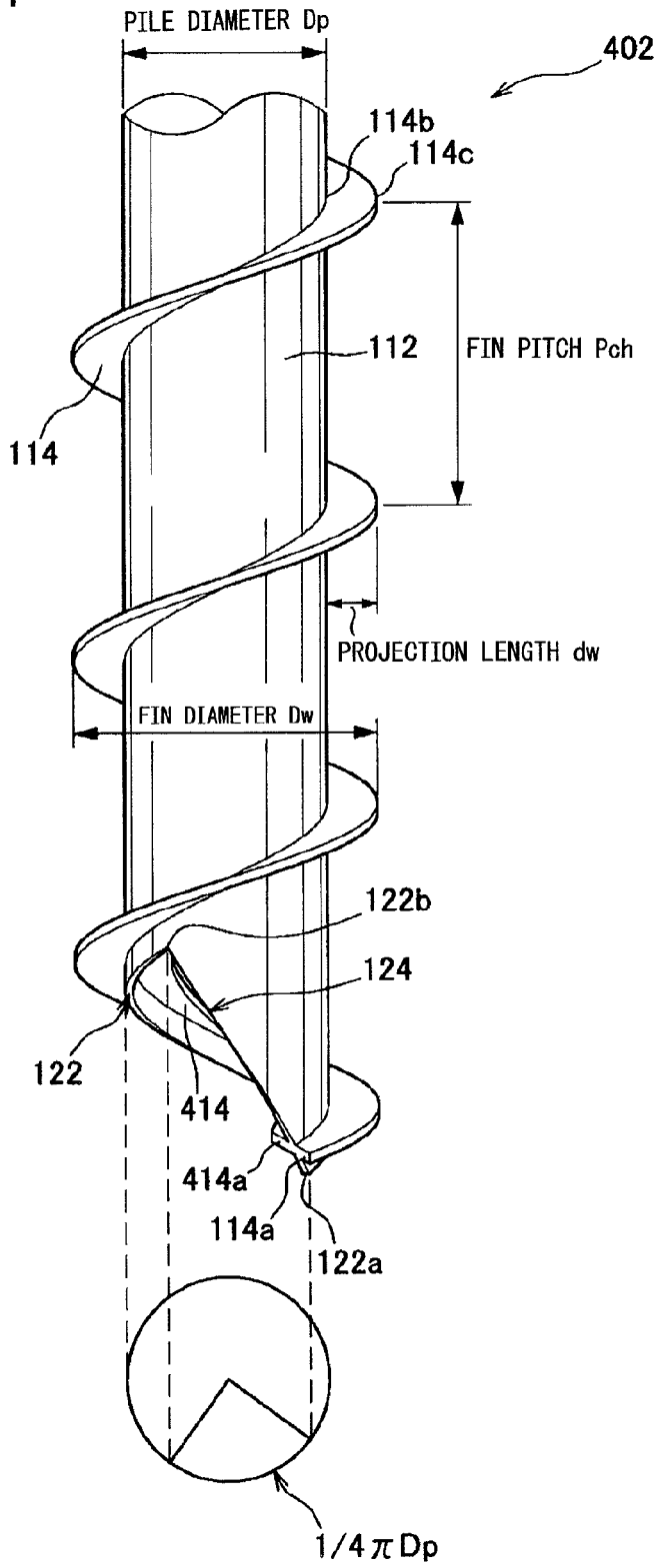
FIG. 14 is a side view showing the lower pile 402 according to the first modification of the same embodiments.
Figure 15:
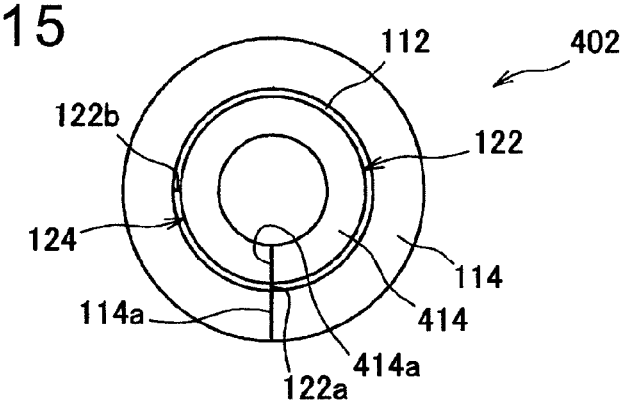
FIG. 15 is a bottom view showing the lower pile 402 according to the first modification of the same embodiments.
Figure 16:
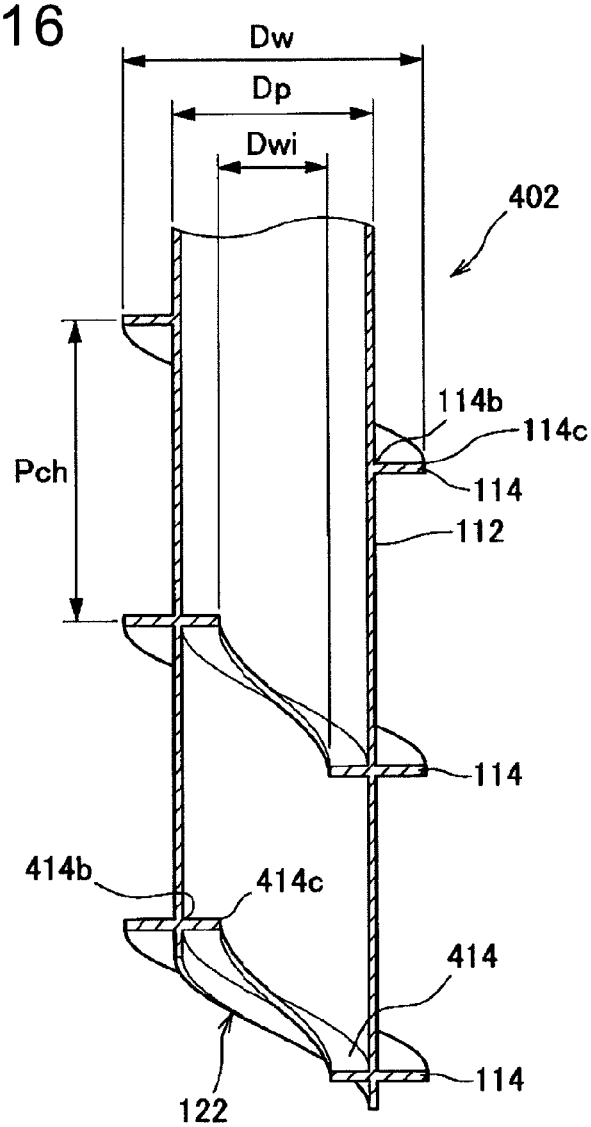
FIG. 16 is a sectional view showing the lower pile 402 according to the first modification of the same embodiments.

FIGS. 13 and 14 are side views showing the lower pile 402 according to the first modification of the present embodiments, as viewed from different directions. FIG. 15 is a bottom view showing the lower pile 402 according to the first modification of the present embodiments. FIG. 16 is a sectional view showing the lower pile 402 according to the first modification of the present embodiments.

The lower pile 402 of the present modification comprises, inter alia, a steel pipe 112, helical fin 114, helical fin 414, fitting 116, first cut region 122, and second cut region 124. Unlike the lower pile 102 of the first embodiment, the lower pile 402 is also provided helically on the inner peripheral surface of the lower pile 402 with a helical fin 414. A detailed explanation of the steel pipe 112, helical fin 114, fitting 116, first cut region 122, and second cut region 124 is omitted because they are the same as in the first embodiment.

The helical fin 414 provided on the inner periphery of the lower pile 402 projects from the same base as the helical fin 114, namely, the base 114*b*, in the direction opposite to the projecting direction of the helical fin 114. The pitch of the helical fin 414 is the same as the pitch of the helical fin 114. Owing to the projection of the helical fin 414 inward from its base 414*b* up to its distal end 414*c*, the fin inner diameter Dwi can, as shown in FIG. 16, be made smaller than the pile diameter Dp. If it should be attempted to expand the fin area by increasing the projection length of the helical fin 114 in one direction outward from the steel pipe 112, the moment acting on the joint between the steel pipe 112 and helical fin 114 would increase. On the other hand, the projection not only outward but also of the helical fin 414 inward as in present embodiments makes it possible not only to reduce the moment acting on the joint between the steel pipe 112 and helical fin 114 but also to increase the fin area of the pile tip while maintaining the pile diameter Dp. As a result, even if the lower pile 402 is constituted to have a steel pipe thickness thinner than the steel pipe thickness of the tip of the lower pile 102 of the steel pipe pile 100 of the first embodiment, it can still achieve a tip bearing capacity equal to or greater than the lower pile 102 of the steel pipe pile 100.

In FIG. 16, the helical fin 414 provided on the inner periphery of the lower pile 402 is formed to continue for about two turns from the tip 414*a* located at the bottom of the lower pile 402, but it should be noted that the present invention is not limited to this example. For example, the helical fin 414 can be provided for only one turn from the tip 414*a* or for an arbitrary length, such as from the tip 414*a* up to an intermediate portion of the lower pile 402.

Next, a lower pile 502 according to a second modification of the present embodiments will be explained with reference to FIGS. 17 to 20. The lower pile 502 differs from the lower pile 402 explained with reference to FIGS. 13 to 16 in the cut regions.

Figure 17:
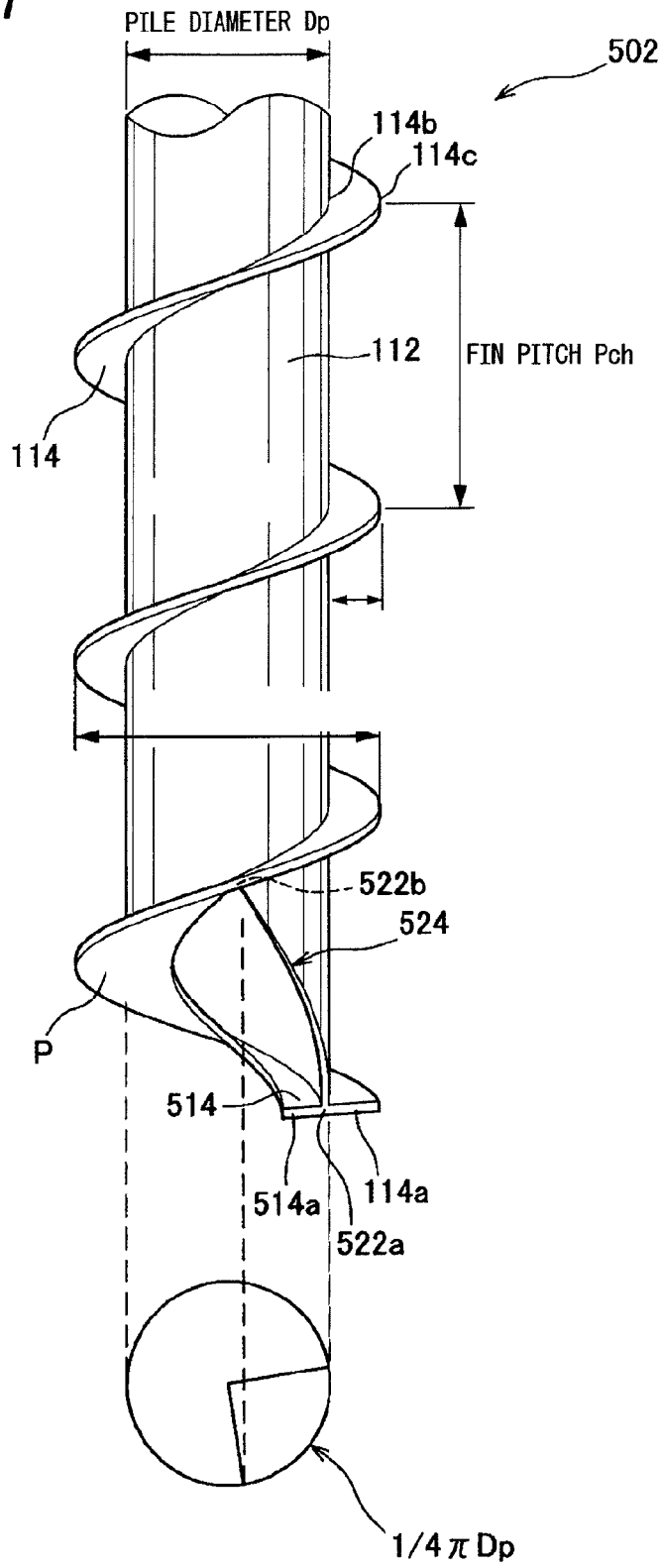
FIG. 17 is a side view showing the lower pile 502 according to a second modification of the same embodiments.
Figure 18:
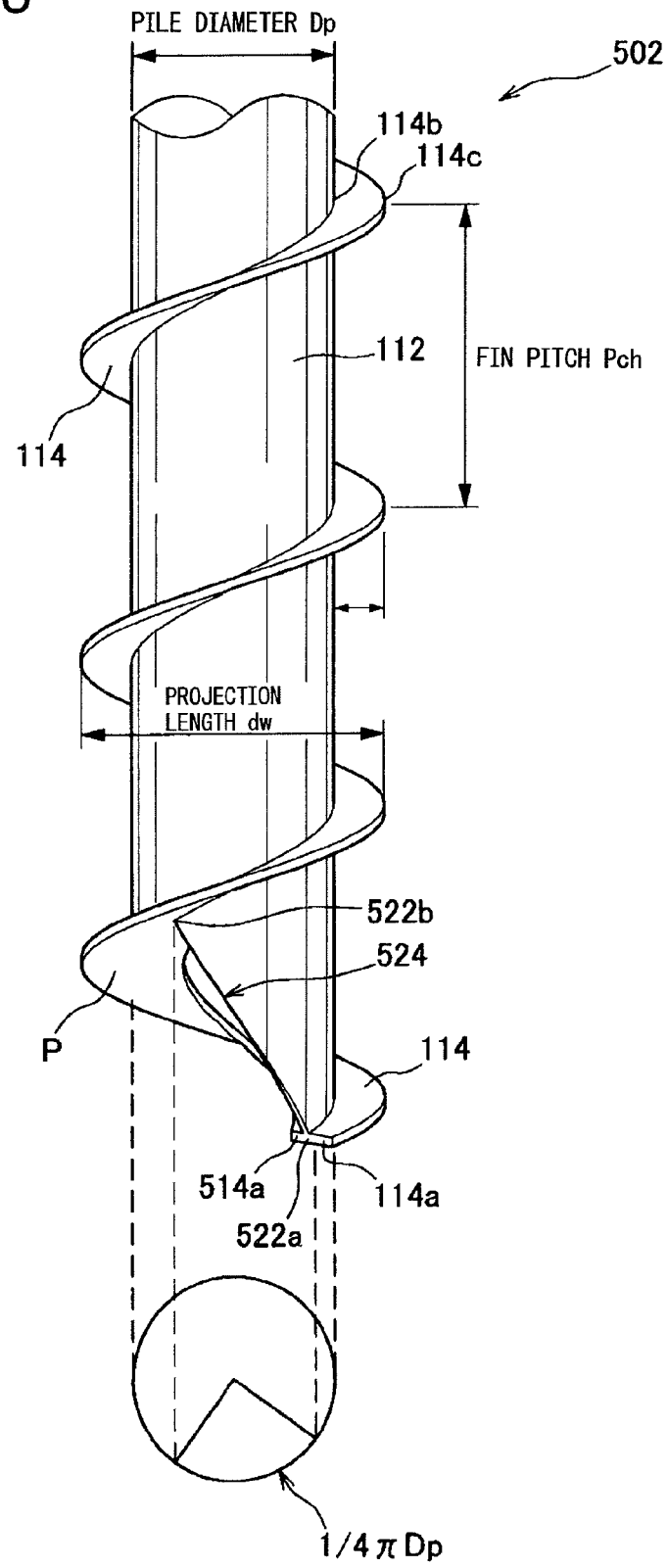
FIG. 18 is a side view showing the lower pile 502 according to the second modification of the same embodiments.
Figure 19:
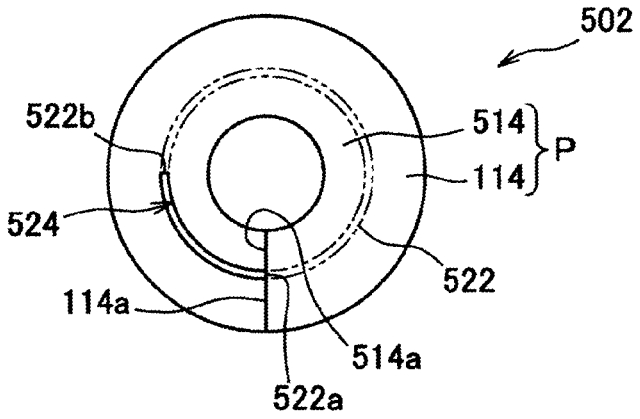
FIG. 19 is a bottom view showing the lower pile 502 according to the second modification of the same embodiments.
Figure 20:
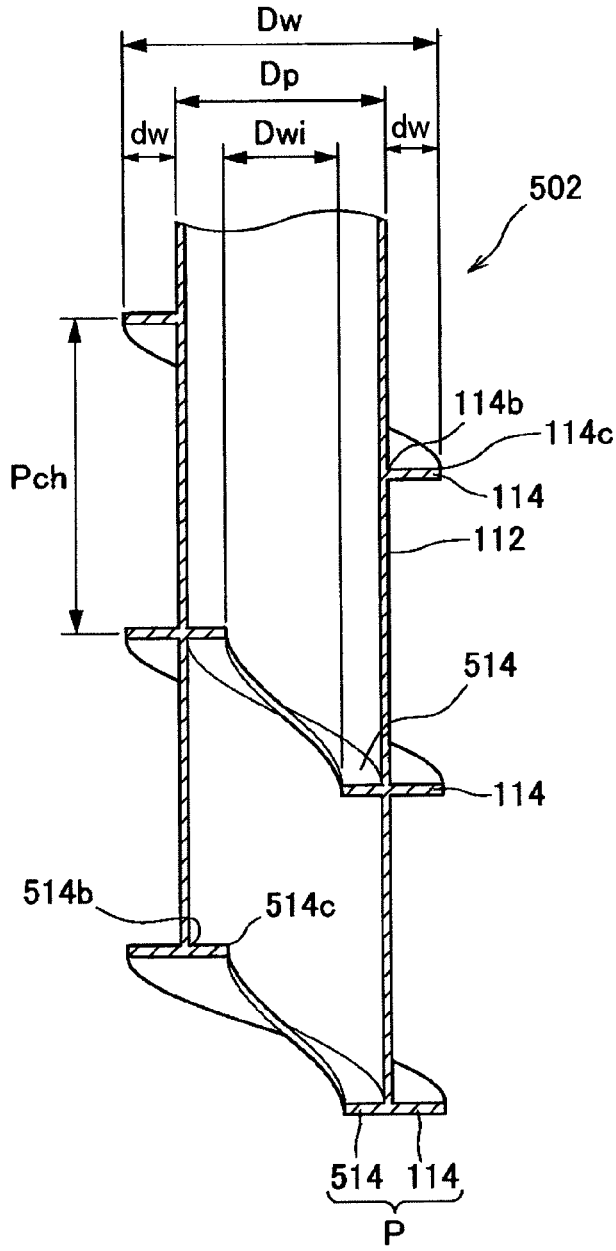
FIG. 20 is a sectional view showing the lower pile 502 according to the second modification of the same embodiments.

FIGS. 17 and 18 are side views showing the lower pile 502 according to the second modification of the present embodiments. FIG. 19 is a bottom view showing the lower pile 502 according to the second modification of the present embodiments. FIG. 20 is a sectional view showing the lower pile 502 according to the second modification of the present embodiments.

The lower pile 502 of the present modification comprises, inter alia, a steel pipe 112, helical fin 114, helical fin 514, fitting 116, first cut region 522, and second cut region 524. Similarly to the lower pile 402 of the foregoing second embodiment, the lower pile 502 is helically provided with a helical fin 514 also on the inner periphery of the lower pile 502. A detailed explanation of the steel pipe 112 and helical fin 114 is omitted.

The first cut region 522 is formed at one end of the steel pipe 112 by cutting part of the whole peripheral length of the steel pipe 112 along the helical fin 114.

The portion of the first cut region 522 located at the end of the lower pile 102 at this time is designated the beginning point 522*a* and the end of the first cut region 522 opposite to the beginning point 522*a* is designated the end point 522*b*.

The second cut region 524 is formed at one end of the steel pipe 112 by cutting a part of the whole periphery of the steel pipe 112 that is a part other than the part forming the first cut region 522 so as to connect the beginning point 522*a* and end point 522*b* of the first cut region 522.

And in present embodiment, differently from in the lower pile 102 and lower pile 402, the first cut region 522 is, as shown in FIGS. 17 to 19, formed by cutting within the outer surfaces of the helical fins 114 and 514. As a result, the helical fin 114 and helical fin 514 form a flat surface P at the lowest part of the lower pile 502.

Figure 21:
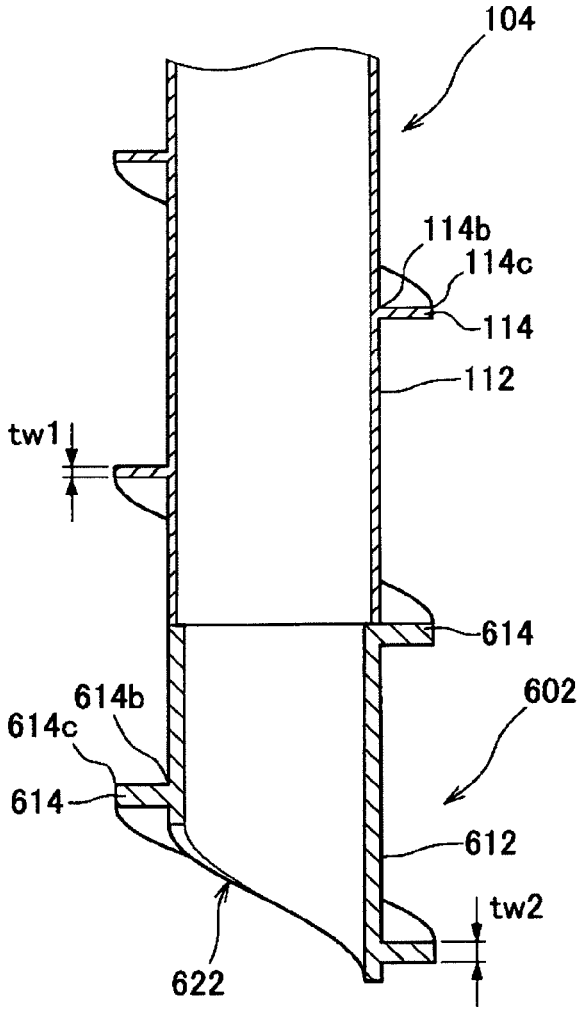
FIG. 21 is a sectional view showing a pile tip 602 and upper pile 104 according to a third modification of the same embodiment.

Next, a pile tip 602 according to a third modification of the present embodiments will be explained with reference to FIG. 21. FIG. 21 is a sectional view showing the pile tip 602 and upper pile 104 according to the third modification of the present embodiments.

As shown in FIG. 21, the pile tip 602 is joined to the upper pile 104. The pile tip 602 comprises, inter alia, a steel pipe 612, helical fin 614, first cut region 622, and second cut region (not shown). The first cut region 622 and second cut region are configured the same as the first cut region 122 and second cut region 124 of the steel pipe pile 100 of the first embodiment.

The first embodiment was explained with respect to the case where the wall thickness of the steel pipe 112 and thickness of the helical fin 114 are the same between the lower pile 102 and upper pile 104, but in the present embodiments, the wall thickness of the steel pipe 612 of the pile tip 602 is thicker than the wall thickness of the steel pipe 112 of the upper pile 104. Further, the thickness tw2 of the helical fin 614 of the pile tip 602 is thicker than the thickness tw1 of the helical fin 114 of the upper pile 104. In the example shown in FIG. 21, the helical fin 614 is formed for one turn about the outer periphery of the steel pipe 612. It should be noted that it is possible to provide the helical fin 614 for one or more turns about the outer periphery. Further, although a case was indicated where the steel pipe 612 and helical fin 614 are both thicker than the steel pipe 112 or the helical fin 114 of the upper pile 104, it is possible for either the steel pipe 612 or the helical fin 614 to be thicker and the other to be the same thickness.

By making the tip of the steel pipe pile thick in this manner, the tip bearing capacity of the steel pipe pile can be increased. A larger vertical reaction force acts on the helical fin of tip of the steel pipe pile than on the helical fin in other regions. By making the thickness of the helical fin 614 of the pile tip 602 of the steel pipe pile and/or the wall thickness of the steel pipe 612 thick as in present embodiment, it is possible not only to ensure a large tip bearing capacity but also to prevent deformation of the tip.

As methods of fabricating the pile tip 602 of the present embodiment can be mentioned, inter alia, (1) the method making it using a thicker thickness for one or both of the helical fin 614 and steel pipe 612 than the thickness of the other helical fin 114 or steel pipe 112, and (2) the method of fabricating it by casting the entire pile tip 602.

As set out in the foregoing, in accordance with the first embodiment of the present invention and the modifications thereof, the tips of the lower piles 102, 302, 402, 502 and 602 have the cutaway shape of the steel pipe 112 and the steel pipe 112 is hollow, so that the steel pipe piles are improved in drivability compared to the case where the pile tip has a closed shape. Moreover, because of the good drivability, the tip regions can be formed with a simple shape to ensure the required strength in the steel pipe pile. In addition, owing to the simple shape of the tip regions, the machining of the cut configurations is relatively easy, whereby the machining cost can be reduced.

Since the conventional steel pipe pile provided with a helical fin solely at the tip is a pile that relies on the pile tip for most of the pile bearing capacity, the thicknesses of the helical fin and steel pipe are thicker than in present embodiments. Further, the conventional steel pipe pile provided with a helical fin solely at the tip does not in the first place give any consideration to the formation of a helical fin extending over the entire pile length as in present embodiments but is focused on bearing a large load with the tip fin, so that a fin pitch that is small and, if anything, closer to flat is desirable.

On the other hand, in the present embodiments, the helical fin 114 is formed continuously on the steel pipe 112 periphery with focus on increasing the peripheral surface friction of the pile, so that the fin pitch Pch is larger than in the prior art. Further, in the present embodiments, it is possible to do the bearing capacity calculation of the steel pipe pile 100 assuming the fin diameter Dw of the helical fin 114 to be the outside diameter of the steel pipe pile 100, so that a large bearing capacity can be anticipated not only from the pile tip but also from the pile peripheral surface friction. In addition, since the force acting on each turn of the fin at the intermediate portion of the pile is usually smaller than the force acting on each turn at the pile tip, the thickness of the helical fin 114 can be made thinner than that of the single fin of the conventional pile tip. However, when particularly large bearing capacity is desired at the pile tip, only the fin/steel pipe thickness of the pile tip may sometimes be increased.

If a conventional steel pipe pile provided with a helical fin solely at the tip is used and a helical fin is also formed on the periphery of the intermediate portion of the steel pipe with the fin pitch maintained small as it is in the conventional helical fin, the amount of steel material increases because the fins are densely arranged around the steel pipe. In addition, the installation efficiency declines because the fin pitch is small. Therefore, it is considered impossible to develop a steel pipe pile having a continuously formed helical fin starting with a conventional steel pipe pile provided with a helical fin solely at the tip.

Moreover, in accordance with the first to third embodiments of the present invention, different helical fins formed discretely are arranged continuously along an imaginary helix or helices. In other words, the interval between the end of one helical fin and the end of another helical fin is arranged to assume the same, or an integral multiple of, the fin pitch Pch. As a result, the fin pitches are equal and make multiple helical fins continuous along an imaginary helix or helices, so that when the steel pipe pile 100 is driven into the ground, the helical fins always pass through the same places in the ground. As a result, the ground is firmly packed between the helical fins without disturbing the ground between the helical fins. Moreover, the earth shear strength between the ground around the steel pipe pile 100 and the firmly packed ground between the helical fins enables the steel pipe pile 100 to support a load from above.

On the other hand, conventionally, since the fin pitch and/or distance between adjacent helical blades was not taken into consideration, if after one of the helical blades passed through the ground around the steel pipe, another helical blade then passed through the ground around the steel pipe, the other helical blade might pass through different places, so that the ground might be disturbed. In contrast to this, present embodiment enables the bearing capacity to be improved compared to the prior art without disturbing the ground.

Although preferred modes of carrying out the present invention where explained in detail with reference to the drawings in the foregoing, the present invention is not limited to these examples. A person having ordinary knowledge in the field of technology to which the present invention belongs will obviously be able to conceive various changes and modifications within the scope of the technical idea set out in the claims, and it is understood that these also naturally fall within the technical scope of the present invention.

Industrial Applicability

The present invention is applicable to a steel pipe pile and a method of installing the steel pipe pile, and particularly applicable to a steel pipe pile provided with a helical fin around the steel pipe and a method of installing the steel pipe pile.

Explanation Of Reference Symbols

100 Steel pipe pile
102 Lower pile
104 Upper pile
112 Steel pipe
114 Helical fin
114*a* Tip
116 Fitting
122 First cut region
124 Second cut region
200 Steel pipe pile
214A Helical fin 214A
214B Helical fin 214B
214C Helical fin 214C
300 Steel pipe pile
302 Lower pile
304 Upper pile
305 Upper pile
313 Helical fin
314 Helical fin
315 Helical fin
400 Steel pipe pile
402 Lower pile

414 Helical fin
414*a* Tip
500 Steel pipe pile
502 Pile tip
514 Helical fin
514*a* Tip
522 First cut region
524 Second cut region
600 Steel pipe pile
602 Pile tip
612 Steel pipe
614 Helical fin
622 First cut region

What is claimed is:

1. A steel pipe pile characterized by comprising a first steel pipe pile that has a hollow first steel pipe and a first helical fin formed helically for at least one turn on the outer periphery of the first steel pipe from one end toward the other end of the first steel pipe at a constantly equal pitch; and a second steel pipe pile that has a hollow second steel pipe and a second helical fin formed helically for at least one turn on the outer periphery of the second steel pipe from one end toward the other end of the second steel pipe at a constantly equal pitch and that is joined at an end to the other end of the first steel pipe pile, the pitch of the first helical fin and the pitch of the second helical fin being equal, and the first helical fin and second helical fin being continuous along an imaginary helix at the joint between the first steel pipe pile and the second steel pipe pile, further comprising at one end of the first steel pipe, a first cut region extending the peripheral length of the first steel pipe along the first helical fin and a second cut region extending the peripheral length of the first steel pipe, wherein the first and second cut regions share a beginning and end point so as to connect and form a cut-out portion which defines a pile tip.

2. The steel pipe pile as set out in claim 1, characterized in that an interval between the first helical fin and second helical fin is an integral multiple of the pitch of the first helical fin or the pitch of the second helical fin.

3. The steel pipe pile as set out in claim 1, characterized by further comprising a third helical fin formed helically on the inner periphery of the steel pipe to project from the same base as the base of the first helical fin in the direction opposite to the projecting direction of the first helical fin, the first cut region being cut along the first helical fin and the third helical fin.

4. The steel pipe pile as set out in claim 1, characterized in that the first cut region is cut at a predetermined distance from the first helical fin.

5. The steel pipe pile as set out in claim 1, characterized in that the first cut region is cut within the outer surface of the first helical fin.

6. The steel pipe pile as set out in claim 1, characterized in that at one end of the steel pipe, the thickness of one or both of the first helical fin and the steel pipe at least at a tip region of the first helical fin is thicker than the thickness of other regions of the first helical fin or the steel pipe, respectively.

7. The steel pipe pile as set out in claim 1, characterized in that at one end of the steel pipe, the fin diameter of at least a tip region of the first helical fin is greater than the fin diameter of the other portions of the first helical fin.

8. The steel pipe pile as set out in claim 1, characterized in that at one end of the steel pipe, the first helical fin and the steel pipe at least at a tip region of the first helical fin are fabricated by casting.

9. The steel pipe pile as set out in claim 1, characterized in that the second helical fin projects from its base to its distal end by a length different from the first helical fin.

10. The steel pipe pile as set out in any of claim 1, characterized in that any or all of the first to fourth helical fins are made of steel bars.

11. The steel pipe pile set out in any of claim 1, characterized in that the ratio Pch/dw of the fin pitch Pch to the projection length dw of the first to fourth helical fins satisfies $Pch/dw \leq 24$.

12. A steel pipe pile characterized by comprising:

a hollow first steel pipe;

a first helical fin formed helically at a constantly equal pitch on the outer periphery of the first steel pipe; and a fourth helical fin formed helically at a constantly equal pitch on the outer periphery of the first steel pipe at a position apart from the first helical fin, the pitch of the first helical fin and the pitch of the fourth helical fin being equal, and the first helical fin and fourth helical fin being continuous along an imaginary helix, further comprising at one end of the first steel pipe, a first cut region extending the peripheral length of the first steel pipe along the first helical fin and a second cut region extending the peripheral length of the first steel pipe, wherein the first and second cut regions share a beginning and end point so as to connect and form a cut-out portion which defines a pile tip.

13. The steel pipe pile as set out in claim 12, characterized in that the interval between the first helical fin and fourth helical fin is an integral multiple of the pitch of the first helical fin or the pitch of the fourth helical fin.

14. The steel pipe pile as set out in claim 12 or 13, characterized in that the fourth helical fin projects from its base to its distal end by a length different from the first helical fin.

15. A method of installing a steel pipe pile characterized by comprising:

a step of, at an embedding site, rotationally driving a first steel pipe pile that has a hollow first steel pipe and a first helical fin formed helically for at least one turn on the outer periphery of the first steel pipe from one end toward the other end of the first steel pipe at a constantly equal pitch;

a step of regulating the driving speed when rotationally driving the first steel pipe pile into the ground so that the first helical fin of the first steel pipe pile passes along substantially the same path in the ground;

a step of joining to the first steel pipe pile a second steel pipe pile that has a hollow second steel pipe and a second helical fin formed helically for at least one turn on the outer periphery of the second steel pipe from one end toward the other end of the second steel pipe at a constantly equal pitch and that is joined at an end to the other end of the first steel pipe pile, with the pitch of the first helical fin and the pitch of the second helical fin being equal, and the first helical fin and second helical fin being continuous along an imaginary helix at the joint between the first steel pipe pile and the second steel pipe pile;

a step of, at the embedding site, rotationally driving the steel pipe pile obtained by joining the first steel pipe pile and the second steel pipe pile; and a step of regulating the driving speed when rotationally driving the steel pipe pile into the ground so that the first helical fin and second helical fin of the steel pipe pile pass along substantially the same path in the ground, further comprising at one end of the first steel pipe, a first cut region extending the peripheral length of the first steel pipe along the first helical fin and a second cut region extending the peripheral length of the first steel pipe, wherein the first and second cut regions share a beginning and end point so as to connect and form a cut-out portion which defines a pile tip.

16. A method of installing a steel pipe pile characterized by comprising:

a step of, at an embedding site, rotationally driving a steel pipe pile comprising a hollow first steel pipe, a first helical fin formed helically at a constantly equal pitch on the outer periphery of the first steel pipe, and a fourth helical fin formed helically at a constantly equal pitch on the outer periphery of the first steel pipe at a position apart from the first helical fin, with the pitch of the first helical fin and the pitch of the fourth helical fin being equal, and the first helical fin and fourth helical fin being continuous along an imaginary helix; and a step of regulating the driving speed when rotationally driving the steel pipe pile into the ground so that the first helical fin and fourth helical fin of the steel pipe pile pass along substantially the same path in the ground, further comprising at one end of the first steel pipe, a first cut region extending the peripheral length of the first steel pipe along the first helical fin and a second cut region extending the peripheral length of the first steel pipe, wherein the first and second cut regions share a beginning and end point so as to connect and form a cut-out portion which defines a pile tip.

* * * * *